US011556081B2

(12) United States Patent
Takahashi et al.

(10) Patent No.: US 11,556,081 B2
(45) Date of Patent: Jan. 17, 2023

(54) DEVELOPING DEVICE

(71) Applicant: CANON KABUSHIKI KAISHA, Tokyo (JP)

(72) Inventors: Masafumi Takahashi, Tsukubamirai (JP); Tomohiro Shiomi, Abiko (JP); Teruaki Tsurusaki, Moriya (JP); Shunichi Koga, Abiko (JP); Osamu Ariizumi, Matsudo (JP); Hideaki Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/129,657

(22) Filed: Dec. 21, 2020

(65) Prior Publication Data

US 2021/0109461 A1 Apr. 15, 2021

Related U.S. Application Data

(63) Continuation of application No. 16/260,926, filed on Jan. 29, 2019, now Pat. No. 10,908,535.

(30) Foreign Application Priority Data

Feb. 2, 2018 (JP) ..... JP2018-017375
Dec. 7, 2018 (JP) ..... JP2018-230244

(51) Int. Cl.
*G03G 15/09* (2006.01)
*G03G 15/08* (2006.01)
(Continued)

(52) U.S. Cl.
CPC ..... *G03G 15/0921* (2013.01); *G03G 15/0808* (2013.01); *G03G 15/0812* (2013.01); *G03G 15/095* (2013.01); *G03G 15/20* (2013.01)

(58) Field of Classification Search
CPC ..... G03G 15/0921; G03G 15/0808; G03G 15/0812; G03G 15/20; G03G 15/095
See application file for complete search history.

(56) References Cited

U.S. PATENT DOCUMENTS 3,709,713 A 1/1973 Turner
5,129,357 A 7/1992 Yamaji
(Continued)

FOREIGN PATENT DOCUMENTS

CN 1115425 A 1/1996
CN 1201918 A 12/1998
(Continued)

OTHER PUBLICATIONS

Sun, Jian-hua, et al. "A Way of Making Multi-polar Magnetic Developing Roller", Journal of Tianjin Adult Higher Learning, No. 1 vol. 3, Feb. 2001.

*Primary Examiner* — Susan S Lee
(74) *Attorney, Agent, or Firm* — Canon U.S.A., Inc. I.P. Division

(57) ABSTRACT

A developing device includes a developer container configured to contain a developer, a developing carrying member configured to carry and feed the developer to a developing position, and a regulating member configured to regulate an amount of the developer carried by the developer carrying member, wherein the developer carrying member includes a magnet provided non-rotatably and stationarily inside the developer carrying member, and wherein the developer carrying member is provided with information regarding magnetic flux density of the magnet.

88 Claims, 20 Drawing Sheets

(51) Int. Cl.
*G03G 15/095* (2006.01)
*G03G 15/20* (2006.01)

(56) References Cited

U.S. PATENT DOCUMENTS

| | | | | |
|---|---|---|---|---|
| 5,768,669 | A | 6/1998 | Yokoyama | |
| 2008/0159790 | A1 | 7/2008 | Kikuchi | |
| 2008/0193165 | A1* | 8/2008 | Nakazawa | G03G 15/5033 399/388 |
| 2008/0298820 | A1* | 12/2008 | Sugiura | G03G 15/0865 399/12 |
| 2010/0247165 | A1 | 9/2010 | Furuya | |
| 2019/0278208 | A1* | 9/2019 | Kojima | G03G 15/5016 |

FOREIGN PATENT DOCUMENTS

| | | | | | |
|---|---|---|---|---|---|
| CN | 1273375 | A | | 11/2000 | |
| CN | 101295158 | A | | 10/2008 | |
| CN | 101609288 | A | | 12/2009 | |
| CN | 102566369 | A | | 7/2012 | |
| CN | 102591172 | A | | 7/2012 | |
| CN | 103309210 | A | | 9/2013 | |
| CN | 104246623 | A | | 12/2014 | |
| CN | 104898390 | A | | 9/2015 | |
| GB | 2418397 | A | * | 3/2006 | G03G 15/55 |
| JP | 61094070 | A | * | 5/1986 | G03G 15/5033 |
| JP | 09034263 | A | | 2/1997 | |
| JP | 2002149014 | A | * | 5/2002 | |
| JP | 2003255689 | A | | 9/2003 | |
| JP | 2004054241 | A | * | 2/2004 | |
| JP | 2004078169 | A | * | 3/2004 | |
| JP | 2004-133019 | A | | 4/2004 | |
| JP | 2004-302250 | A | | 10/2004 | |
| JP | 2006317507 | A | * | 11/2006 | |
| JP | 2008145533 | A | | 6/2008 | |
| JP | 2010085462 | A | * | 4/2010 | |
| JP | 2014178498 | A | | 9/2014 | |
| JP | 2017102268 | A | | 6/2017 | |
| JP | 2017116597 | A | | 6/2017 | |
| KR | 20030027706 | A | | 4/2003 | |
| KR | 2012-0073141 | A | | 7/2012 | |
| KR | 20150003300 | A | | 1/2015 | |

* cited by examiner

DEVELOPING DEVICE

CROSS-REFERENCE TO RELATED APPLICATIONS

The present application is a continuation of U.S. patent application Ser. No. 16/260,926, filed on Jan. 29, 2019, which claims priority from Japanese Patent Application No. 2018-017375 filed Feb. 2, 2018 and Japanese Patent Application No. 2018-230244 filed Dec. 7, 2018, which are hereby incorporated by reference herein in their entireties.

BACKGROUND OF THE INVENTION

Field of the Invention

Aspects of the present invention generally relate to a developing device.

Description of the Related Art

A developing device includes a regulating blade serving as a developer regulating member that regulates an amount of a developer (a developer coat amount) which is borne on the surface of a developer bearing member, which bears a developer containing toner and a carrier, to develop an electrostatic latent image formed on an image bearing member. The regulating blade is located opposite to the developer bearing member via a predetermined gap between the regulating blade and the developer bearing member (hereinafter referred to as an "SB gap") over the longitudinal direction of the developer bearing member. The SB gap refers to the shortest distance between the developer bearing member, which is supported by a developing frame member, and the regulating blade, which is fixed to the developing frame member. Adjusting the size of the SB gap leads to the adjustment of a developer which is conveyed to a developing region in which the developer bearing member faces the image bearing member.

In a developing device discussed in Japanese Patent Application Laid-Open No. 2012-145937, a magnet having a plurality of magnetic poles is fixedly located inside the developer bearing member, and an S2-pole (regulating pole) and an N1-pole, which are opposite popes, are located near the regulating blade. The regulating pole has a local maximum peak value of magnetic flux density at a position which is on the upstream side of the regulating blade with respect to the rotational direction of the developer bearing member and closest to the regulating blade.

The local maximum peak value of magnetic flux density of the regulating pole included in each magnet may have a variation between individual magnets.

For example, in a case where the local maximum peak value of magnetic flux density of the regulating pole is large, the magnitude of a magnetic force acting on a carrier contained in a developer having contact with the upstream side of the regulating blade with respect to the rotational direction of the developer bearing member has a tendency to become large. Therefore, in a case where the local maximum peak value of magnetic flux density of the regulating pole is larger than a predetermined value, the developer coat amount which is obtained when the size of the SB gap is set at the same value becomes larger than in a case where the local maximum peak value of magnetic flux density of the regulating pole is the predetermined value. On the other hand, in a case where the local maximum peak value of magnetic flux density of the regulating pole is small, the magnitude of a magnetic force acting on a carrier contained in a developer having contact with the upstream side of the regulating blade with respect to the rotational direction of the developer bearing member has a tendency to become small. Therefore, in a case where the local maximum peak value of magnetic flux density of the regulating pole is smaller than the predetermined value, the developer coat amount which is obtained when the size of the SB gap is set at the same value becomes smaller than in a case where the local maximum peak value of magnetic flux density of the regulating pole is the predetermined value.

In this way, in a case where the size of the SB gap is set at the same value without consideration for the local maximum peak value of magnetic flux density of the regulating pole, a variation in the developer coat amount may occur for each individual developing device due to a variation in local maximum peak value of magnetic flux density of the regulating pole for each individual magnet.

Moreover, the local maximum peak position of magnetic flux density of the regulating pole included in each magnet may have a variation for each individual magnet. Similarly, in a case where the size of the SB gap is set at the same value without consideration for the local maximum peak position of magnetic flux density of the regulating pole, a variation in the developer coat amount may occur for each individual developing device due to a variation in local maximum peak position of magnetic flux density of the regulating pole for each individual magnet.

SUMMARY OF THE INVENTION

A first aspect of the present invention is directed to preventing or reducing a variation in a developer coat amount for each individual developing device by adjusting the size of the SB gap with consideration for a local maximum peak value of magnetic flux density of a regulating pole included in a magnet.

The first aspect of the present invention provides a method for fixing a regulating blade to a developing frame member, the regulating blade being located opposite to a developer bearing member and configured to regulate an amount of a developer borne by the developer bearing member, the developer bearing member being supported by the developing frame member and configured to bear the developer to develop an electrostatic latent image formed on an image bearing member, the method including determining a target value for a gap between the developer bearing member supported by the developing frame member and the regulating blade that is fixed to the developing frame member, based on input information about a local maximum peak value of magnetic flux density of a predetermined magnetic pole which is located closest to the regulating blade when the regulating blade is fixed to the developing frame member among a plurality of magnetic poles included in a magnet fixedly located inside the developer bearing member and configured to generate a magnetic field for causing the developer to be borne by the developer bearing member, and fixing the regulating blade to the developing frame member so that the gap is set at the target value for the gap determined in the determining over a longitudinal direction of the developer bearing member.

The first aspect of the present invention further provides a method for fixing a regulating blade to a developing frame member, the regulating blade being located opposite to a developer bearing member and configured to regulate an amount of a developer borne by the developer bearing member, the developer bearing member being supported by the developing frame member and configured to bear the developer to develop an electrostatic latent image formed on an image bearing member, the method including determining an upper limit value and a lower limit value for a gap between the developer bearing member supported by the developing frame member and the regulating blade that is fixed to the developing frame member, based on input information about a local maximum peak value of magnetic flux density of a predetermined magnetic pole which is located closest to the regulating blade when the regulating blade is fixed to the developing frame member among a plurality of magnetic poles included in a magnet fixedly located inside the developer bearing member and configured to generate a magnetic field for causing the developer to be borne by the developer bearing member, and fixing the regulating blade to the developing frame member so that the gap is set at between the upper limit value and the lower limit value for the gap determined in the determining over a longitudinal direction of the developer bearing member.

The first aspect of the present invention further provides a developing device including a developing frame member, a developer bearing member supported by the developing frame member and configured to bear a developer to develop an electrostatic latent image formed on an image bearing member, a magnet fixedly located inside the developer bearing member, having a plurality of magnetic poles, and configured to generate a magnetic field for causing the developer to be borne by the developer bearing member, a regulating blade fixed to the developing frame member, located opposite to the developer bearing member, and configured to regulate an amount of the developer borne by the developer bearing member, and a two-dimensional barcode having, recorded therein, information about a local maximum peak value of magnetic flux density of a predetermined magnetic pole which is located closest to the regulating blade when the regulating blade is fixed to the developing frame member among the plurality of magnetic poles, wherein the regulating blade is fixed to the developing frame member so that a gap between the developer bearing member supported by the developing frame member and the regulating blade that is fixed to the developing frame member is set at a target value for the gap corresponding to the local maximum peak value of magnetic flux density of the predetermined magnetic pole over a longitudinal direction of the developer bearing member.

The first aspect of the present invention further provides a developer bearing member supported by a developing frame member and configured to bear a developer to develop an electrostatic latent image formed on an image bearing member, the developer bearing member including a magnet fixedly located inside the developer bearing member, having a plurality of magnetic poles, and configured to generate a magnetic field for causing the developer to be borne by the developer bearing member, and a two-dimensional barcode having, recorded therein, information about a local maximum peak value of magnetic flux density of a predetermined magnetic pole which is located closest to a regulating blade fixed to the developing frame member, located opposite to the developer bearing member, and configured to regulate an amount of the developer borne by the developer bearing member when the regulating blade is fixed to the developing frame member among the plurality of magnetic poles.

The first aspect of the present invention further provides a magnet fixedly located inside a developer bearing member and configured to generate a magnetic field for causing a developer to be borne by the developer bearing member, the developer bearing member being supported by a developing frame member and configured to bear the developer to develop an electrostatic latent image formed on an image bearing member, the magnet including a plurality of magnetic poles, and a two-dimensional barcode having, recorded therein, information about a local maximum peak value of magnetic flux density of a predetermined magnetic pole which is located closest to a regulating blade fixed to the developing frame member, located opposite to the developer bearing member, and configured to regulate an amount of the developer borne by the developer bearing member when the regulating blade is fixed to the developing frame member among the plurality of magnetic poles.

A second aspect of the present invention is directed to preventing or reducing a variation in a developer coat amount for each individual developing device by adjusting the size of the SB gap with consideration for a local maximum peak position of magnetic flux density of a regulating pole included in a magnet.

The second aspect of the present invention provides a method for fixing a regulating blade to a developing frame member, the regulating blade being located opposite to a developer bearing member and configured to regulate an amount of a developer borne by the developer bearing member, the developer bearing member being supported by the developing frame member and configured to bear the developer to develop an electrostatic latent image formed on an image bearing member, the method including determining a target value for a gap between the developer bearing member supported by the developing frame member and the regulating blade that is fixed to the developing frame member, based on input information about a local maximum peak position of magnetic flux density of a predetermined magnetic pole which is located closest to the regulating blade when the regulating blade is fixed to the developing frame member among a plurality of magnetic poles included in a magnet fixedly located inside the developer bearing member and configured to generate a magnetic field for causing the developer to be borne by the developer bearing member, and of fixing the regulating blade to the developing frame member so that the gap is set at the target value for the gap determined in the determining over a longitudinal direction of the developer bearing member.

The second aspect of the present invention further provides a method for fixing a regulating blade to a developing frame member, the regulating blade being located opposite to a developer bearing member and configured to regulate an amount of a developer borne by the developer bearing member, the developer bearing member being supported by the developing frame member and configured to bear the developer to develop an electrostatic latent image formed on an image bearing member, the method including determining an upper limit value and a lower limit value for a gap between the developer bearing member supported by the developing frame member and the regulating blade that is fixed to the developing frame member, based on input information about a local maximum peak position of magnetic flux density of a predetermined magnetic pole which is located closest to the regulating blade when the regulating blade is fixed to the developing frame member among a plurality of magnetic poles included in a magnet fixedly located inside the developer bearing member and configured to generate a magnetic field for causing the developer to be borne by the developer bearing member, and fixing the regulating blade to the developing frame member so that the gap is set at between the upper limit value and the lower limit value for the gap determined in the determining over a longitudinal direction of the developer bearing member.

The second aspect of the present invention further provides a developing device including a developing frame member, a developer bearing member supported by the developing frame member and configured to bear a developer to develop an electrostatic latent image formed on an image bearing member, a magnet fixedly located inside the developer bearing member, having a plurality of magnetic poles, and configured to generate a magnetic field for causing the developer to be borne by the developer bearing member, a regulating blade fixed to the developing frame member, located opposite to the developer bearing member, and configured to regulate an amount of the developer borne by the developer bearing member, and a two-dimensional barcode having, recorded therein, information about a local maximum peak position of magnetic flux density of a predetermined magnetic pole which is located closest to the regulating blade when the regulating blade is fixed to the developing frame member among the plurality of magnetic poles, wherein the regulating blade is fixed to the developing frame member so that a gap between the developer bearing member supported by the developing frame member and the regulating blade that is fixed to the developing frame member is set at a target value for the gap corresponding to the local maximum peak position of magnetic flux density of the predetermined magnetic pole over a longitudinal direction of the developer bearing member.

The second aspect of the present invention further provides a developer bearing member supported by a developing frame member and configured to bear a developer to develop an electrostatic latent image formed on an image bearing member, the developer bearing member including a magnet fixedly located inside the developer bearing member, having a plurality of magnetic poles, and configured to generate a magnetic field for causing the developer to be borne by the developer bearing member, and a two-dimensional barcode having, recorded therein, information about a local maximum peak position of magnetic flux density of a predetermined magnetic pole which is located closest to a regulating blade fixed to the developing frame member, located opposite to the developer bearing member, and configured to regulate an amount of the developer borne by the developer bearing member when the regulating blade is fixed to the developing frame member among the plurality of magnetic poles.

The second aspect of the present invention further provides a magnet fixedly located inside a developer bearing member and configured to generate a magnetic field for causing a developer to be borne by the developer bearing member, the developer bearing member being supported by a developing frame member and configured to bear the developer to develop an electrostatic latent image formed on an image bearing member, the magnet including a plurality of magnetic poles, and a two-dimensional barcode having, recorded therein, information about a local maximum peak position of magnetic flux density of a predetermined magnetic pole which is located closest to a regulating blade fixed to the developing frame member, located opposite to the developer bearing member, and configured to regulate an amount of the developer borne by the developer bearing member when the regulating blade is fixed to the developing frame member among the plurality of magnetic poles.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. Furthermore, the following exemplary embodiments are not intended to limit the present invention defined in the claims, and, moreover, not all of the combinations of features described in the following exemplary embodiments are necessarily essential for solutions in the present invention. The present invention can be implemented in various use applications, such as printers, various types of printing machines, copy machines, facsimile machines, and multifunction peripherals.

<Configuration of Image Forming Apparatus>

Figure 1:
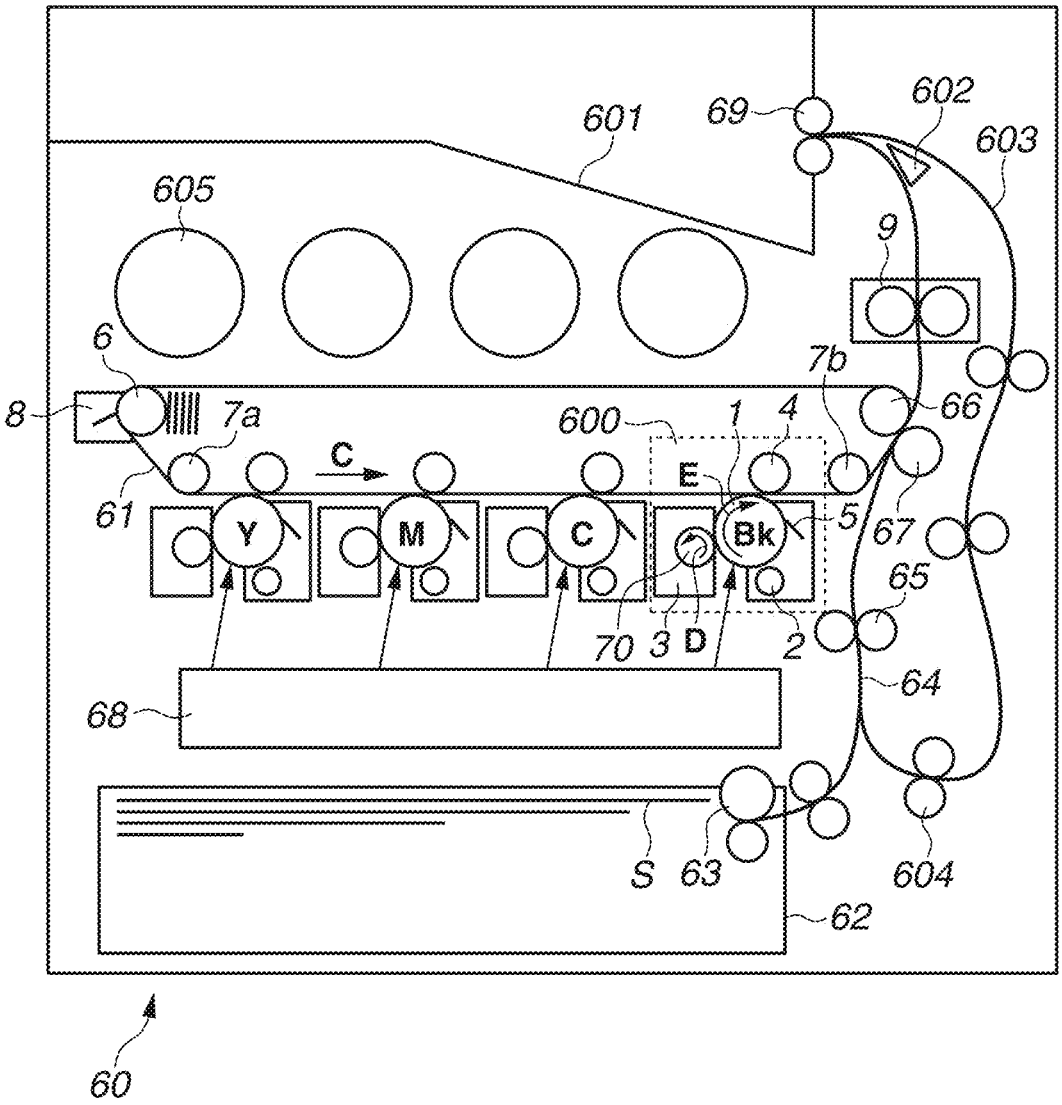
FIG. 1 is a sectional view illustrating a configuration of an image forming apparatus.

First, a configuration of an image forming apparatus according to a first exemplary embodiment of the present invention is described with reference to the sectional view of FIG. 1. As illustrated in FIG. 1, an image forming apparatus 60 includes an intermediate transfer belt (ITB) 61 of the endless shape, which serves as an intermediate transfer member, and four image forming units 600, which are arranged from the upstream side to the downstream side along the rotational direction of the intermediate transfer belt 61 (the direction of arrow C in FIG. 1). The image forming units 600 form toner images of yellow (Y), magenta (M), cyan (C), and black (Bk), respectively.

Each image forming unit 600 includes a rotatable photosensitive drum 1, which serves as an image bearing member. Moreover, each image forming unit 600 further includes a charging roller 2 serving as a charging unit, a developing device 3 serving as a developing unit, a primary transfer roller 4 serving as a primary transfer unit, and a photosensitive member cleaner 5 serving as a photosensitive member cleaning unit, which are arranged along the rotational direction of the photosensitive drum 1 (the direction of arrow E in FIG. 1).

Each developing device 3 is attachable to and detachable from the image forming apparatus 60. Each developing device 3 includes a developing container which contains a two-component developer (hereinafter simply referred to as a "developer") including non-magnetic toner (hereinafter simply referred to as "toner") and magnetic carrier. Moreover, toner cartridges in which toners of respective colors Y, M, C, and Bk are respectively contained are attachable to and detachable from the image forming apparatus 60. Toners of respective colors Y, M, C, and Bk are supplied to the respective developing containers via toner conveyance pathways. Furthermore, details of the developing device 3 are described below with reference to FIG. 2 to FIG. 5.

The intermediate transfer belt 61 is supported to extend between a tension roller 6, a driven roller 7*a*, the primary transfer roller 4, a driven roller 7*b*, and a secondary transfer inner roller 66, and is driven to be conveyed in the direction of arrow C in FIG. 1. The secondary transfer inner roller 66 also serves as a driving roller which drives the intermediate transfer belt 61. In conjunction with the rotation of the secondary transfer inner roller 66, the intermediate transfer belt 61 rotates in the direction of arrow C in FIG. 1.

The intermediate transfer belt 61 is pressed by the primary transfer roller 4 from the reverse surface side of the intermediate transfer belt 61. Moreover, bringing the intermediate transfer belt 61 into contact with the photosensitive drum 1 forms a primary transfer nip portion serving as a primary transfer portion between the photosensitive drum 1 and the intermediate transfer belt 61.

An intermediate transfer member cleaner 8 serving as a belt cleaning unit is kept in contact with a position facing the tension roller 6 across the intermediate transfer belt 61. Moreover, a secondary transfer outer roller 67 serving as a secondary transfer unit is arranged at a position facing the secondary transfer inner roller 66 across the intermediate transfer belt 61. The intermediate transfer belt 61 is sandwiched between the secondary transfer inner roller 66 and the secondary transfer outer roller 67. This forms a secondary transfer nip portion serving as a secondary transfer portion between the secondary transfer outer roller 67 and the intermediate transfer belt 61. In the secondary transfer nip portion, applying a predetermined pressing force and a transfer bias (electrostatic load bias) causes a toner image to be attracted to and formed on the surface of a sheet S (for example, paper or a film).

Sheets S are contained in a sheet containing unit 62 (for example, a feeding cassette or a feeding deck) in a stacked condition. A feeding unit 63 feeds a sheet S in conformity with image forming timing with use of, for example, a frictional separation method using, for example, a feeding roller. The sheet S fed out by the feeding unit 63 is conveyed to a registration roller 65 located on the way in a conveyance path 64. After being subjected to skew correction and timing correction by the registration roller 65, the sheet S is conveyed to the secondary transfer nip portion. In the secondary transfer nip portion, the sheet S becomes coincident in timing with the toner image, so that secondary transfer is performed.

A fixing device 9 is arranged at the downstream side of the secondary transfer nip portion in the direction of conveyance of the sheet S. A predetermined pressure and a predetermined amount of heat being applied by the fixing device 9 to the sheet S conveyed to the fixing device 9 cause the toner image to be fused and firmly fixed onto the surface of the sheet S. The sheet S having an image fixed thereto in the above-mentioned way is directly discharged to a discharge tray 601 by the forward rotation of a discharge roller 69.

In the case of performing two-sided image formation, after the sheet S is conveyed by the forward rotation of the discharge roller 69 until the trailing edge thereof passes through a diverter 602, the discharge roller 69 is caused to rotate backward. This switches the sheet S between the leading and trailing edges thereof and causes the sheet S to be conveyed to a two-sided conveyance path 603. After that, in conformity with next image forming timing, the sheet S is re-conveyed to the conveyance path 64 by a re-feeding roller 604.

<Image Forming Process>

At the time of image formation, the photosensitive drum 1 is driven to rotate by a motor. The charging roller 2 preliminarily electrically charges the surface of the photosensitive drum 1, which is being driven to rotate. An exposure device 68 forms an electrostatic latent image on the surface of the photosensitive drum 1 electrically charged by the charging roller 2, based on a signal representing image information input to the image forming apparatus 60. The photosensitive drum 1 allows an electrostatic latent image to be formed thereon in a plurality of sizes.

The developing device 3 includes a rotatable developing sleeve 70 serving as a developer bearing member which bears a developer. The developing device 3 develops an electrostatic latent image formed on the surface of the photosensitive drum 1 with use of a developer borne on the surface of the developing sleeve 70. This causes toner to adhere to the surface of the photosensitive drum 1, thus forming a visible image. A transfer bias (electrostatic load bias) is applied to the primary transfer roller 4, so that the toner image formed on the surface of the photosensitive drum 1 is transferred onto the intermediate transfer belt 61. Toner slightly remaining on the surface of the photosensitive drum 1 after primary transfer (transfer residual toner) is recovered by the photosensitive member cleaner 5 and is then prepared for a next image forming process.

Image forming processes of respective colors, which are processed in parallel by the image forming units 600 of the respective colors Y, M, C, and Bk, are performed at such timing that respective toner images are sequentially superposed on the toner image of color on the upstream side primarily transferred onto the intermediate transfer belt 61. As a result, a full-color toner image is formed on the intermediate transfer belt 61, and the toner image is then conveyed to the secondary transfer nip portion. A transfer bias is applied to the secondary transfer outer roller 67, so that the toner image formed on the intermediate transfer belt 61 is transferred onto the sheet S conveyed to the secondary transfer nip portion. Toner slightly remaining on the intermediate transfer belt 61 after the sheet S passes through the secondary transfer nip portion (transfer residual toner) is recovered by the intermediate transfer member cleaner 8. The fixing device 9 fixes the toner image transferred onto the sheet S. The sheet S subjected to fixing processing by the fixing device 9 is discharged to the discharge tray 601.

After a series of image forming processes such as that described above ends, a preparation is made for a next image forming operation.

<Configuration of Developing Device>

Figure 2:
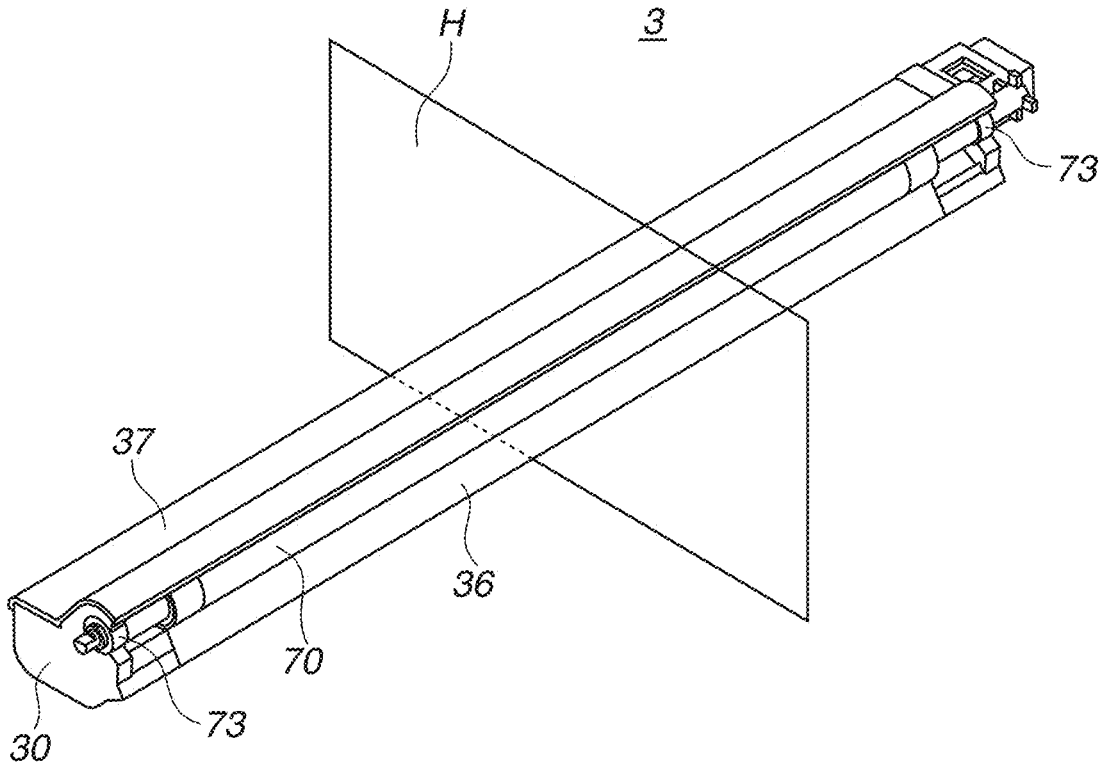
FIG. 2 is a perspective view illustrating a configuration of a developing device.
Figure 3:
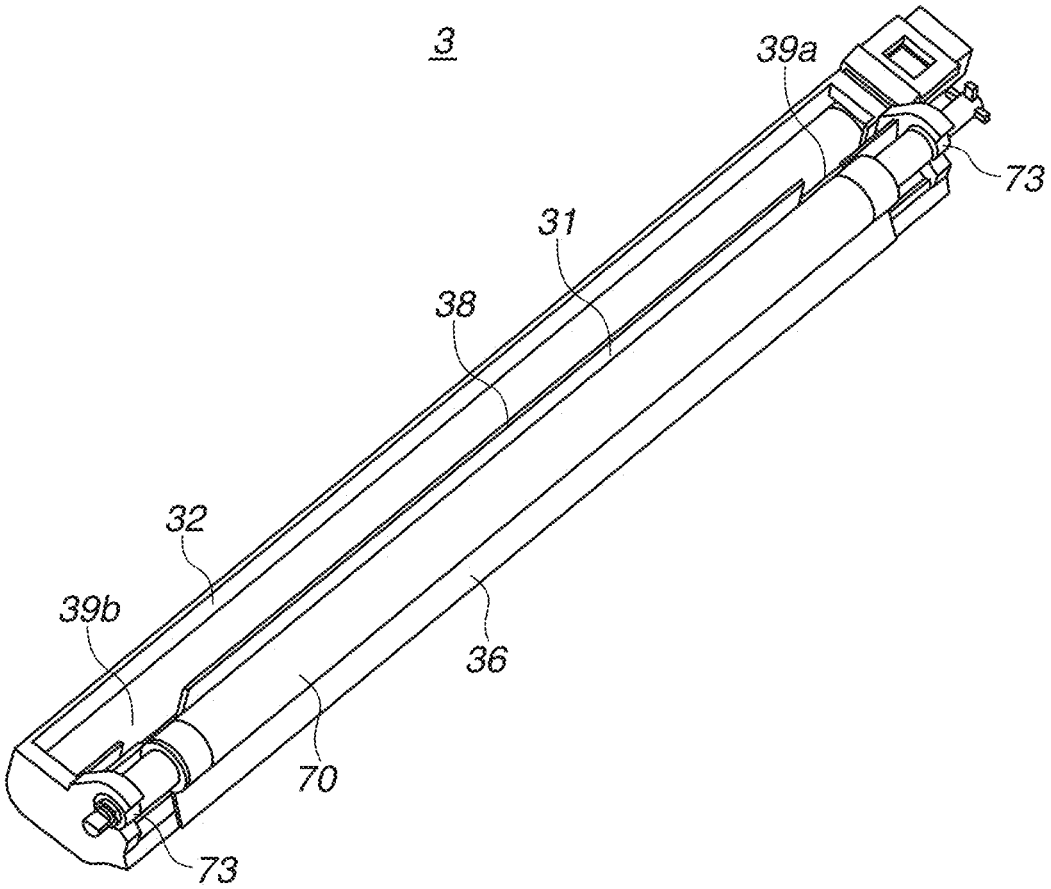
FIG. 3 is a perspective view illustrating the configuration of the developing device.
Figure 4:
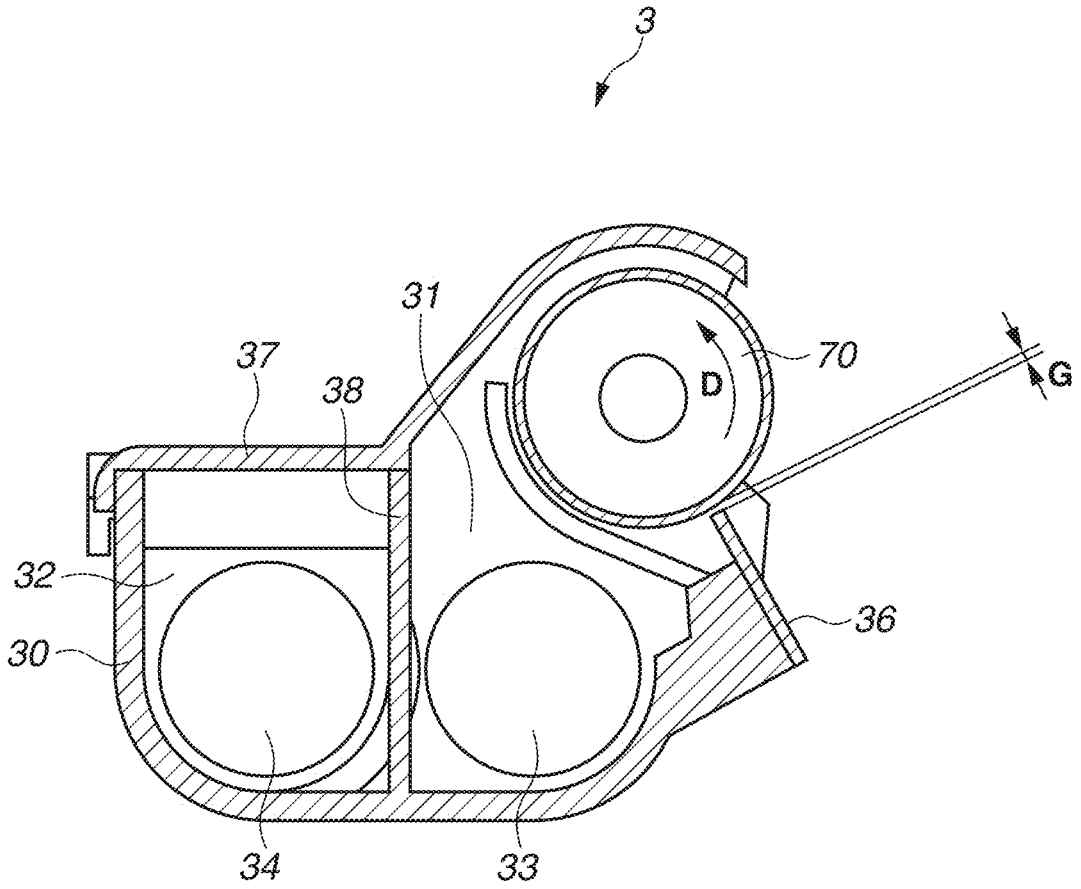
FIG. 4 is a sectional view illustrating the configuration of the developing device.
Figure 5:
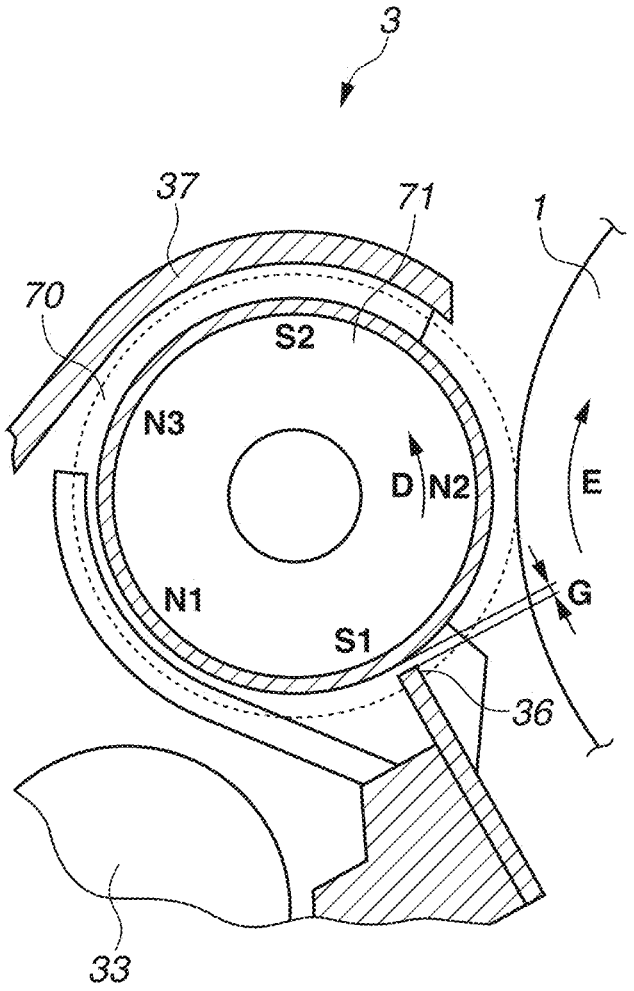
FIG. 5 is a sectional view illustrating the configuration of the developing device.

Next, a configuration of the developing device 3 is described with reference to the perspective view of FIG. 2, the perspective view of FIG. 3, the sectional view of FIG. 4, and the sectional view of FIG. 5. FIG. 4 is a sectional view of the developing device 3 in a cross-section H illustrated in FIG. 2. FIG. 5 is a diagram illustrating the developing sleeve 70 and surrounding portions thereof in an enlarged manner in the sectional view of FIG. 4.

The developing device 3 includes a developing container which contains a developer including toner and carrier. The developing container is composed of a developing frame member 30 made from resin, which is molded with resin, and a cover frame member 37 made from resin, which is molded with resin.

The developing frame member 30 is provided with an opening at a position equivalent to a developing region in which the developing sleeve 70 faces the photosensitive drum 1. The developing sleeve 70 is located to be rotatable with respect to the developing frame member 30 in such a manner that a part of the developing sleeve 70 is exposed at the opening of the developing frame member 30. Bearings 73 serving as bearing members are respectively provided at both end portions in the longitudinal direction of the developing sleeve 70 (the rotational axis line direction of the developing sleeve 70). Both end portions in the longitudinal direction of the developing sleeve 70 (the rotational axis line direction of the developing sleeve 70) are pivotally supported by the bearings 73 in a rotatable manner.

The cover frame member 37 covers a part of the opening of the developing frame member 30 in such a manner that a part of the outer circumference surface of the developing sleeve 70 is covered over the longitudinal direction of the developing sleeve 70 (the rotational axis line direction of the developing sleeve 70). Furthermore, the cover frame member 37 can be configured to be molded integrally with the developing frame member 30 or can be configured to be molded separately from the developing frame member 30 and attached to the developing frame member 30 as a separate member. FIG. 2, FIG. 4, and FIG. 5 illustrate a state in which the cover frame member 37 is attached to the developing frame member 30. On the other hand, FIG. 3 illustrates a state in which the cover frame member 37 is not yet attached to the developing frame member 30.

The inside of the developing frame member 30 is partitioned into a developing chamber 31 serving as a first chamber and an agitation chamber 32 serving as a second chamber by a partition wall 38, which is located to extend in vertical direction. In other words, the partition wall 38 plays a role as a partition portion for separating the developing chamber 31 and the agitation chamber 32. Furthermore, the partition wall 38 can be configured to be molded integrally with the developing frame member 30 or can be configured to be molded separately from the developing frame member 30 and attached to the developing frame member 30 as a separate member.

The developing device 3 includes a first communicating portion 39*a*, which allows a developer in the developing chamber 31 to be transmitted from the developing chamber 31 to the agitation chamber 32, and a second communicating portion 39*b*, which allows a developer in the agitation chamber 32 to be transmitted from the agitation chamber 32 to the developing chamber 31. In this way, the developing chamber 31 and the agitation chamber 32 communicate with each other at both ends thereof in the longitudinal direction via the first communicating portion 39*a* and the second communicating portion 39*b*.

A magnet 71, which serves as a magnetic field generation unit that generates a magnetic field for causing a developer to be borne on the surface of the developing sleeve 70, is fixedly located inside the developing sleeve 70. The magnet 71, which is a columnar magnet roll, has a plurality of magnetic poles and is supported in such a way as not to be rotatable. As illustrated FIG. 5, the magnet 71 has an N2-pole, which is a developing pole located opposite to the photosensitive drum 1 in the developing region, and an S2-pole, an N3-pole, an N1-pole, and an S1-pole in order along the rotational direction of the developing sleeve 70 (the direction of arrow D in FIG. 5) from the N2-pole. Furthermore, the magnet 71 can be the one configured by pasting together a plurality of magnet pieces to a metal shaft used to fix the magnet 71 inside the developing sleeve 70. Moreover, the magnet 71 can be the one integrally configured with one magnet including a magnet shaft portion used to fix the magnet 71 inside the developing sleeve 70.

A developer in the developing chamber 31 is scooped up under the influence of a magnetic field caused by the magnetic poles of the magnet 71 and is thus supplied to the developing sleeve 70. Since, in this way, a developer is supplied from the developing chamber 31 to the developing sleeve 70, the developing chamber 31 is also referred to as a "supply chamber".

In the developing chamber 31, a first conveyance screw 33, which serves as a conveyance unit that agitates and conveys a developer in the developing chamber 31, is located opposite to the developing sleeve 70. The first conveyance screw 33 includes a rotational shaft, which serves as a rotatable shaft portion, and a spiral blade portion, which serves as a developer conveyance portion, provided along the outer circumference of the rotational shaft, and is supported in such a way as to be rotatable with respect to the developing frame member 30. Bearing members are respectively provided at both end portions in the longitudinal direction of the first conveyance screw 33.

Moreover, in the agitation chamber 32, a second conveyance screw 34, which serves as a conveyance unit that agitates a developer in the agitation chamber 32 and conveys the developer in a direction opposite to the direction of the first conveyance screw 33, is located. The second conveyance screw 34 includes a rotational shaft, which serves as a rotatable shaft portion, and a spiral blade portion, which serves as a developer conveyance portion, provided along the outer circumference of the rotational shaft, and is supported in such a way as to be rotatable with respect to the developing frame member 30. Bearing members are respectively provided at both end portions in the longitudinal direction of the second conveyance screw 34. Then, when the first conveyance screw 33 and the second conveyance screw 34 are driven to rotate, a circulation pathway in which a developer circulates between the developing chamber 31 and the agitation chamber 32 via the first communicating portion 39*a* and the second communicating portion 39*b* is formed.

A regulating blade 36, which serves as a developer regulating member that regulates the amount of a developer which is borne on the surface of the developing sleeve 70 (hereinafter referred to as a "developer coat amount"), is fixed to the developing frame member 30. Furthermore, the regulating blade 36 can be a regulating blade made from a metal such as stainless steel or can be a regulating blade made from resin which is molded with resin.

The regulating blade 36 is located out of contact with the developing sleeve 70 in such a way as to face the developing sleeve 70. Moreover, the regulating blade 36 is located opposite to the developing sleeve 70 across a predetermined gap between the regulating blade 36 and the developing sleeve 70 (hereinafter referred to as an "SB gap G") over the longitudinal direction of the developing sleeve 70 (the rotational axis line direction of the developing sleeve 70). The SB gap G is assumed to be the shortest distance between the maximum image region of the developing sleeve 70 and the maximum image region of the regulating blade 36.

Furthermore, the maximum image region of the developing sleeve 70 is a region of the developing sleeve 70 corresponding to the maximum image region among image regions in which images are able to be formed on the surface of the photosensitive drum 1 with respect to the rotational axis line direction of the developing sleeve 70. Moreover, the maximum image region of the regulating blade 36 is a region of the regulating blade 36 corresponding to the maximum image region among image regions in which images are able to be formed on the surface of the photosensitive drum 1 with respect to the rotational axis line direction of the developing sleeve 70.

In the first exemplary embodiment, since the photosensitive drum 1 allows an electrostatic latent image to be formed thereon in a plurality of sizes, the maximum image region is assumed to refer to an image region corresponding to the largest size (for example, A3 size) among image regions of a plurality of sizes in which images are able to be formed on the surface of the photosensitive drum 1. On the other hand, in a modification example in which the photosensitive drum 1 allows an electrostatic latent image to be formed thereon only in a single size, the maximum image region is assumed to be replaced to refer to an image region of the single size in which an image is able to be formed on the surface of the photosensitive drum 1.

Figure 6:
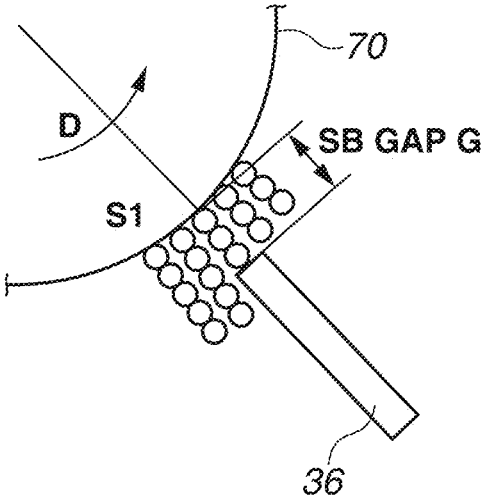
FIG. 6 is a schematic diagram illustrating the behavior of a developer in the vicinity of a regulating blade.

Next, the behavior of a developer in the vicinity of the regulating blade 36 is described with reference to the schematic diagram of FIG. 6.

The S1-pole, which is a magnetic pole located closest to the regulating blade 36 among a plurality of magnetic poles (N2-pole, S2-pole, N3-pole, N1-pole, and S1-pole) included in the magnet 71 as illustrated in FIG. 5, is hereinafter referred to as a "regulating pole S1".

The regulating blade 36 is located approximately opposite to the local maximum peak position of magnetic flux density of the regulating pole S1. In other words, the regulating blade 36 is located opposite to the surface of the developing sleeve 70 within the range of ±10 degrees in the rotational direction of the developing sleeve 70 centered on the local maximum peak position of magnetic flux density of the regulating pole S1.

The developer supplied from the developing chamber 31 to the developing sleeve 70 is affected by a magnetic field caused by a plurality of magnetic poles included in the magnet 71. Moreover, the developer regulated and scraped up by the regulating blade 36 is apt to easily stagnate at an upstream portion of the SB gap G. As a result, a developer accumulation is formed on the upstream side of the regulating blade 36 in the rotational direction of the developing sleeve 70. Then, a developer that is a part of the developer accumulation is conveyed in such a way as to pass through the SB gap G in association with the rotation of the developing sleeve 70. At this time, the layer thickness of the developer which passes through the SB gap G is regulated by the regulating blade 36. In this way, a thin layer of developer is formed on the surface of the developing sleeve 70. Then, a predetermined amount of developer borne on the surface of the developing sleeve 70 is conveyed to a developing region in association with the rotation of the developing sleeve 70. Therefore, adjusting the size of the SB gap G leads to adjusting the amount of a developer which is conveyed to the developing region.

The developer conveyed to the developing region magnetically rises up at the developing region, thus forming a magnetic brush. The formed magnetic brush comes into contact with the photosensitive drum 1, so that toner included in the developer is supplied to the photosensitive drum 1. Then, an electrostatic latent image formed on the surface of the photosensitive drum 1 is developed as a toner image. A developer remaining on the surface of the developing sleeve 70 after passing through the developing region and supplying toner to the photosensitive drum 1 (hereinafter referred to as a "developer after developing process") is scraped up from the surface of the developing sleeve 70 by a repelling magnetic field formed between magnetic poles of the same polarity of the magnet 71. The developer after developing process scraped up from the surface of the developing sleeve 70 drops to the developing chamber 31, thus being recovered to the developing chamber 31.

<Developer Coat Amount>

Next, a relationship between the size of the SB gap G and the developer coat amount is described with reference to FIGS. 7A and 7B.

Figure 7A:
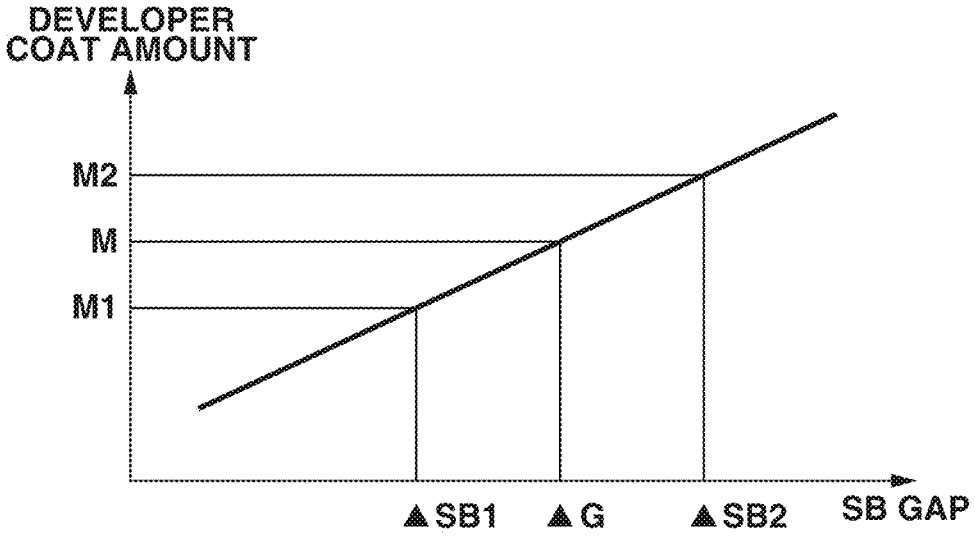
FIGS. 7A and 7B are diagrams used to explain a relationship between the SB gap and a developer coat amount.

As illustrated in FIG. 7A, the relationship between the size of the SB gap G and the developer coat amount is generally a relationship in which, as the size of the SB gap G becomes larger, the developer coat amount becomes larger.

To ensure the quality level of an image formed on the surface of the photosensitive drum 1, the acceptable range of the developer coat amount is previously determined. The acceptable range of the developer coat amount is hereinafter referred to as a "variation amount in the developer coat amount (ΔM)".

Figure 7B:
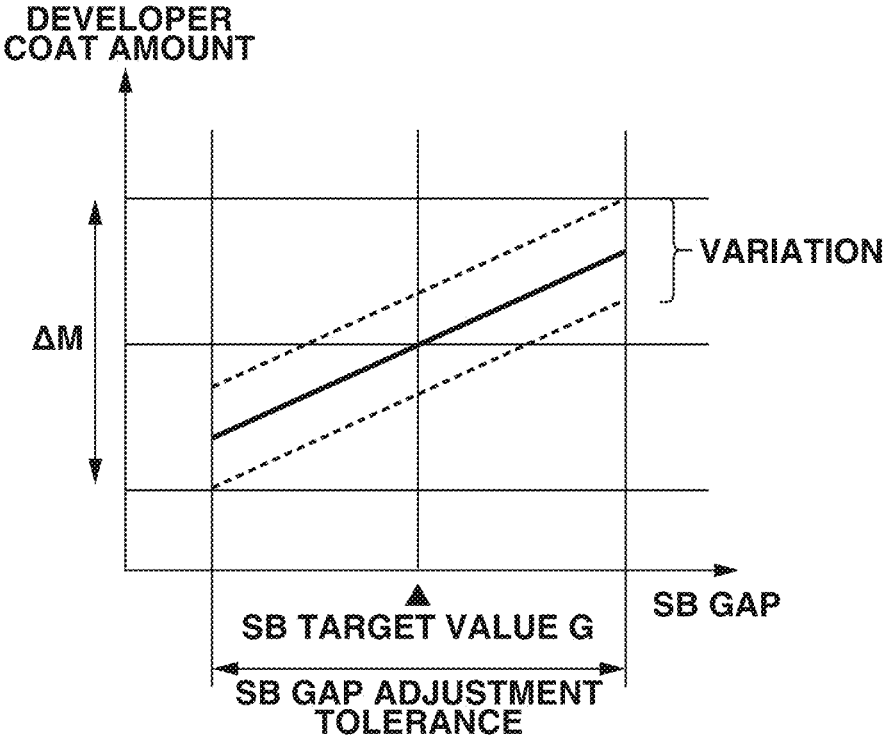

As illustrated in FIG. 7B, the correlation between the size of the SB gap G and the developer coat amount has a width of variation of ΔM. Examples of the cause of variation of ΔM include environmental variation, temporal change, component tolerance, and adjustment tolerance. Therefore, taking such a width of variation of ΔM into consideration, the present exemplary embodiment determines the adjustment range of the SB gap G (in other words, the upper limit value and the lower limit value of the SB gap G) in such a manner that the developer coat amount satisfies ΔM. Specifically, the present exemplary embodiment determines that the size of the SB gap G according to which the developer coat amount becomes a center value of ΔM is the center value of the adjustment range of the SB gap G (a target value for the SB gap G).

Next, a relationship between the adjustment range of the SB gap G and the developer coat amount is described with reference to FIGS. 8A, 8B, and 8C.

Figure 8A:
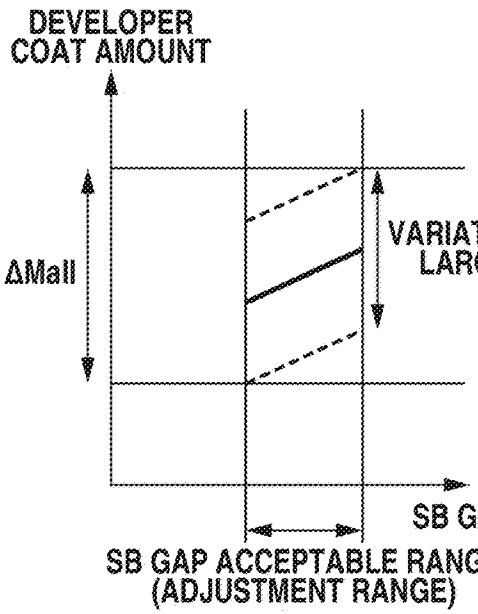
FIGS. 8A, 8B, and 8C are diagrams used to explain a relationship between an adjustment range of the SB gap and the developer coat amount.

In a case where the variation of ΔM is large, as illustrated in FIG. 8A, the acceptable range of the size of the SB gap G (the adjustment range of the SB gap G) becomes narrow.

Figure 8B:
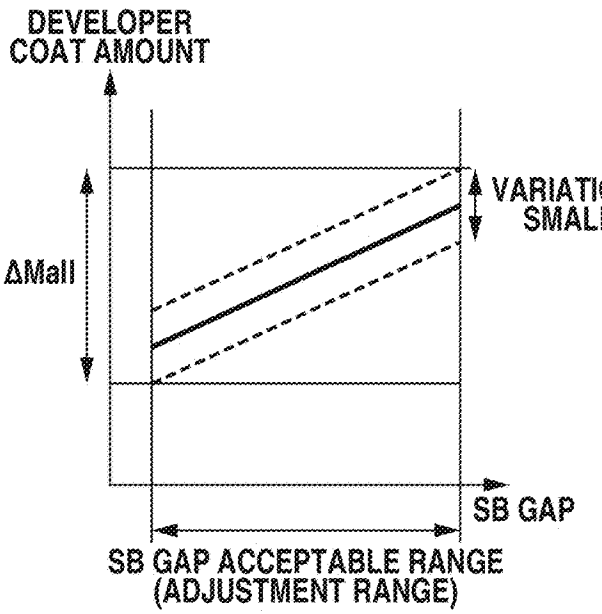
Figure 8C:
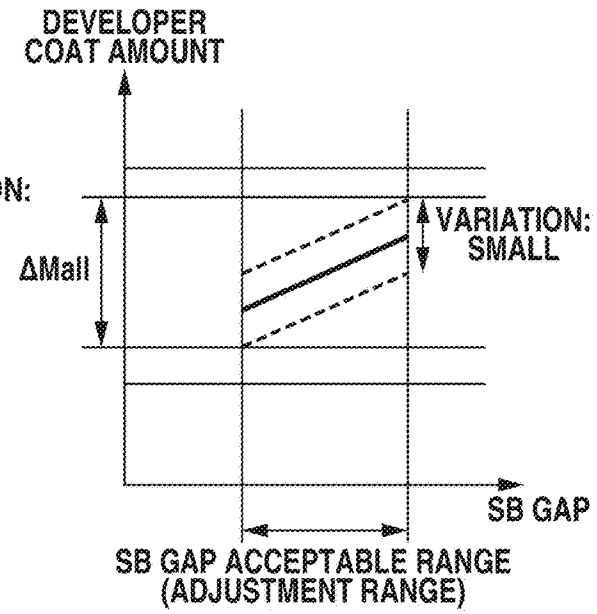

On the other hand, in a case where the variation of ΔM is small, as illustrated in FIG. 8B, the acceptable range of the size of the SB gap G (the adjustment range of the SB gap G) becomes wide. Moreover, as illustrated in FIG. 8C, in a case where the variation of ΔM is small and the adjustment range of the SB gap G is set narrow, the variation amount in the developer coat amount ($\Delta M_{all}$) becomes small. Accordingly, in order to ensure that the developer coat amount is uniform over the longitudinal direction of the developing sleeve 70 (the rotational axis line direction of the developing sleeve 70), the variation of ΔM is required to be made smaller.

Next, a relationship between the variation of the "local maximum peak value" of magnetic flux density of the regulating pole S1 for each individual magnet 71 and the developer coat amount is described with reference to FIGS. 9A and 9B.

Figure 9A:
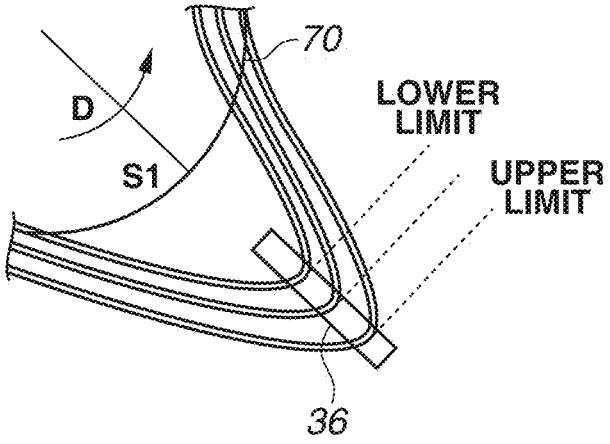
FIGS. 9A and 9B are diagrams used to explain a relationship between the local maximum peak value of magnetic flux density of a regulating pole and the developer coat amount.
Figure 9B:
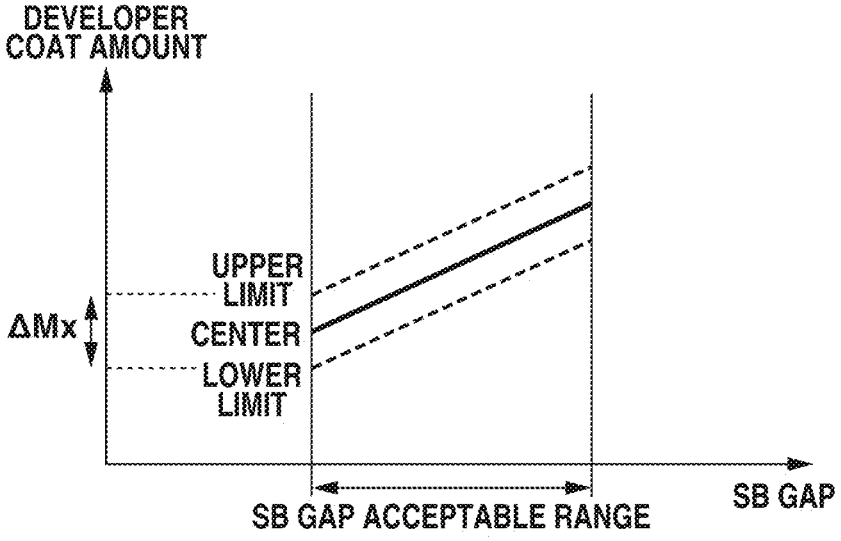

FIG. 9A illustrates a distribution of magnitudes of magnetic forces (magnetic force lines) in the vicinity of the regulating pole S1. The "local maximum peak value" of magnetic flux density of the regulating pole S1 may have a variation for each individual magnet 71. This is because, in a case where a magnet roll having a plurality of magnetic poles is manufactured, the "local maximum peak value" of magnetic flux density of each magnetic pole is adjusted by magnetizing the magnet 71 in the order of, for example, a developing pole N2, a magnetic pole (scraping-up pole) N3 for scraping up a developer, and a regulating pole S1. Therefore, the "local maximum peak value" of magnetic flux density of the regulating pole S1 may vary according to the relative relationship with the "local maximum peak value" of magnetic flux density of the developing pole N2 or the "local maximum peak value" of magnetic flux density of the scraping-up pole N3.

The variation of the "local maximum peak value" of magnetic flux density of the regulating pole S1 for each individual magnet 71 causes the distribution of magnitudes of magnetic forces in the vicinity of the regulating pole S1 to vary as illustrated in FIG. 9A, so that the behavior of a developer or the density of a developer in the vicinity of the regulating blade 36 changes. As a result, the amount of a developer which passes through the SB gap G (the developer coat amount) varies, so that there is a possibility that a variation in the developer coat amount occurs for each individual developing device 3.

For example, suppose that the size of the SB gap G is set at the same value regardless of individual differences of the "local maximum peak value" of magnetic flux density of the regulating pole S1 of the magnet 71. In this case, as illustrated in FIG. 9B, due to the variation of the "local maximum peak value" of magnetic flux density of the regulating pole S1 for each individual magnet 71, the developer coat amount would vary by a portion thereof corresponding to an individual difference of the "local maximum peak value" of magnetic flux density of the regulating pole S1 (referred to as "$\Delta M_x$").

Next, a relationship between the variation of the "local maximum peak position" of magnetic flux density of the regulating pole S1 for each individual magnet 71 and the developer coat amount is described with reference to FIGS. 10A and 10B.

Figure 10A:
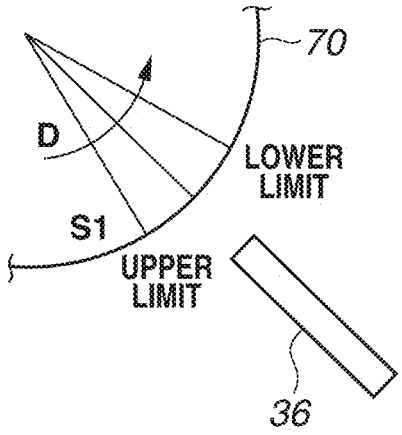
FIGS. 10A and 10B are diagrams used to explain a relationship between the local maximum peak position of magnetic flux density of a regulating pole and the developer coat amount.
Figure 10B:
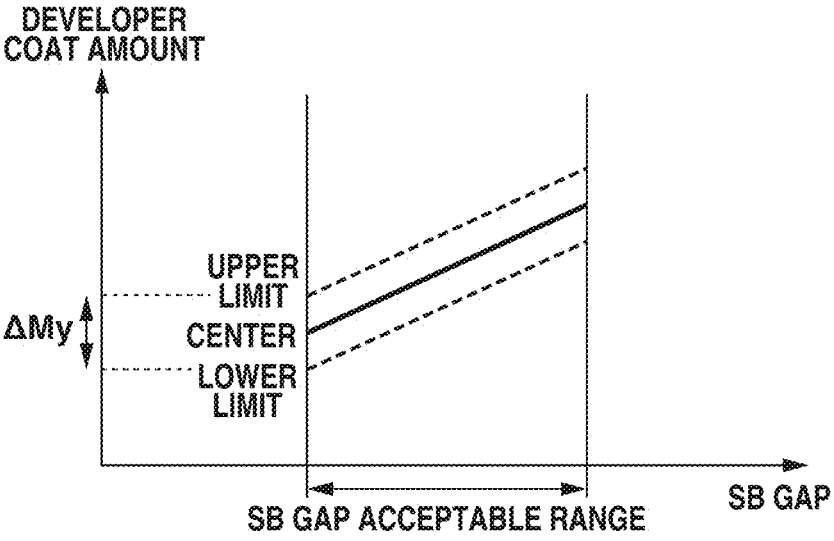

FIG. 10A illustrates an upper limit value and a lower limit value of the "local maximum peak position" of magnetic flux density of the regulating pole S1. The "local maximum peak position" of magnetic flux density of the regulating pole S1 may have a variation for each individual magnet 71. This is because, in a case where a magnet roll having a plurality of magnetic poles is manufactured, the "local maximum peak position" of magnetic flux density of each magnetic pole is adjusted by magnetizing the magnet 71 in the order of, for example, a developing pole N2, a magnetic pole (scraping-up pole) N3 for scraping up a developer, and a regulating pole S1. Therefore, the "local maximum peak position" of magnetic flux density of the regulating pole S1 may vary according to the relative relationship with the "local maximum peak position" of magnetic flux density of the developing pole N2 or the "local maximum peak position" of magnetic flux density of the scraping-up pole N3.

The variation of the "local maximum peak position" of magnetic flux density of the regulating pole S1 for each individual magnet 71 causes the distribution of magnitudes of magnetic forces in the vicinity of the regulating pole S1 to vary, so that the behavior of a developer or the density of a developer in the vicinity of the regulating blade 36 changes. As a result, the amount of a developer which passes through the SB gap G (the developer coat amount) varies, so that there is a possibility that a variation in the developer coat amount occurs for each individual developing device 3.

For example, suppose that the size of the SB gap G is set at the same value regardless of individual differences of the "local maximum peak position" of magnetic flux density of the regulating pole S1 of the magnet 71. In this case, as illustrated in FIG. 10B, due to the variation of the "local maximum peak position" of magnetic flux density of the regulating pole S1 for each individual magnet 71, the developer coat amount would vary by a portion thereof corresponding to an individual difference of the "local maximum peak position" of magnetic flux density of the regulating pole S1 (referred to as "$\Delta M_y$").

In this way, the variation of characteristics for each individual magnet 71, such as the "local maximum peak value" and "local maximum peak position" of magnetic flux density of the regulating pole S1, causes a variation of the distribution of magnitudes of magnetic forces in the vicinity of the regulating pole S1.

For example, in a case where the "local maximum peak value" of magnetic flux density of the regulating pole S1 is large, the magnitude of a magnetic force acting on a carrier contained in a developer having contact with the upstream side of the regulating blade 36 with respect to the rotational direction of the developing sleeve 70 has a tendency to become large. Therefore, in a case where the "local maximum peak value" of magnetic flux density of the regulating pole S1 is larger than a predetermined value, the developer coat amount which is obtained when the size of the SB gap G is set at the same value becomes larger than in a case where the "local maximum peak value" of magnetic flux density of the regulating pole S1 is the predetermined value.

On the other hand, in a case where the "local maximum peak value" of magnetic flux density of the regulating pole S1 is small, the magnitude of a magnetic force acting on a carrier contained in a developer having contact with the upstream side of the regulating blade 36 with respect to the rotational direction of the developing sleeve 70 has a tendency to become small. Therefore, in a case where the "local maximum peak value" of magnetic flux density of the regulating pole S1 is smaller than the predetermined value, the developer coat amount which is obtained when the size of the SB gap G is set at the same value becomes smaller than in a case where the "local maximum peak value" of magnetic flux density of the regulating pole S1 is the predetermined value.

In this way, in a case where the size of the SB gap G is set at the same value without consideration for the local maximum peak value of magnetic flux density of the regulating pole S1, a variation in the developer coat amount may occur for each individual developing device 3 due to a variation in local maximum peak value of magnetic flux density of the regulating pole S1 for each individual magnet 71. Therefore, in order to prevent or reduce a variation in the developer coat amount for each individual developing device 3, it is desirable to adjust the size of the SB gap G for each individual developing device 3 with consideration for the "local maximum peak value" of magnetic flux density of the regulating pole S1 for each individual magnet 71. A first aspect of the present invention is directed to preventing or reducing a variation in the developer coat amount for each individual developing device 3 by adjusting the size of the SB gap G with consideration for the "local maximum peak value" of magnetic flux density of the regulating pole S1 included in the magnet 71.

Similarly, in a case where the size of the SB gap G is set at the same value without consideration for the local maximum peak position of magnetic flux density of the regulating pole S1, a variation in the developer coat amount may occur for each individual developing device 3 due to a variation in local maximum peak position of magnetic flux density of the regulating pole S1 for each individual magnet 71. Therefore, in order to prevent or reduce a variation in the developer coat amount for each individual developing device 3, it is desirable to adjust the size of the SB gap G for each individual developing device 3 with consideration for the "local maximum peak position" of magnetic flux density of the regulating pole S1 for each individual magnet 71. A second aspect of the present invention is directed to preventing or reducing a variation in the developer coat amount for each individual developing device 3 by adjusting the size of the SB gap G with consideration for the "local maximum peak position" of magnetic flux density of the regulating pole S1 included in the magnet 71.

Details of each of the first aspect and the second aspect of the present invention are described as follows.

First, a relationship between the adjustment range of the SB gap G and the developer coat amount is described with reference to FIGS. 11A, 11B, and 11C, FIGS. 12A, 12B, and 12C, and FIGS. 13A, 13B, and 13C.

Figure 11A:
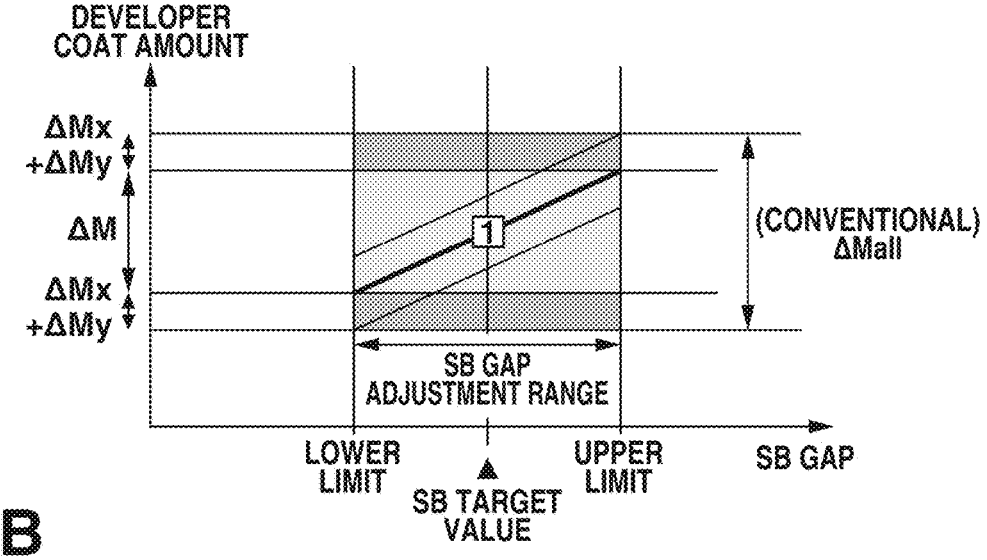
FIGS. 11A, 11B, and 11C are diagrams used to explain a relationship between an adjustment range of the SB gap and the developer coat amount.

FIG. 11A illustrates a relationship between the adjustment range of the SB gap G and the developer coat amount in a case where the "local maximum peak value" of magnetic flux density of the regulating pole S1 is a center value and the "local maximum peak position" of magnetic flux density of the regulating pole S1 is a center value. In the example illustrated in FIG. 11A, as the characteristic of the magnet 71, the relationship between the size of the SB gap G and the developer coat amount (in other words, the sensitivity of the variation of ΔM to the developer coat amount) is represented by a "characteristic line L1".

Figure 12A:
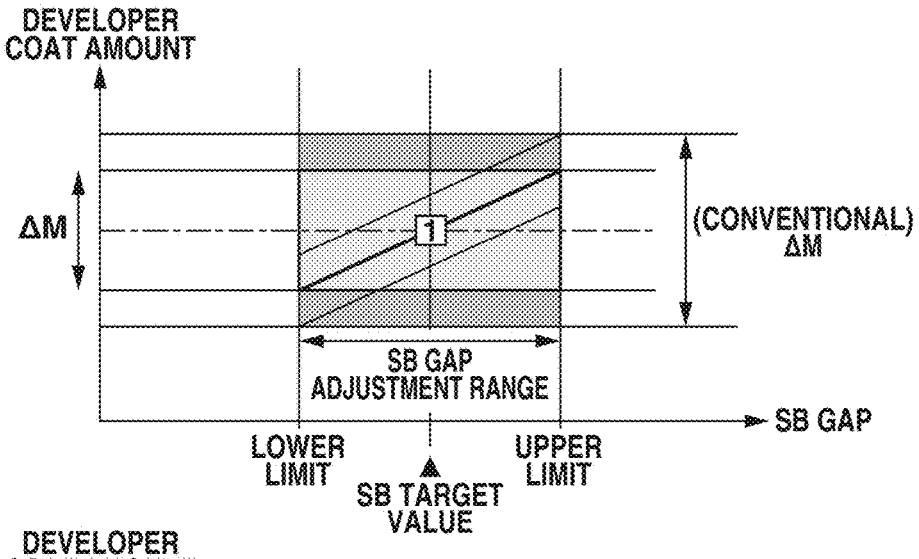
FIGS. 12A, 12B, and 12C are diagrams used to explain a relationship between an adjustment range of the SB gap and the developer coat amount.

In a case where the characteristic of the magnet 71 is the "characteristic line L1", there is no need to take into consideration a portion of the developer coat amount corresponding to an individual difference of the "local maximum peak value" of magnetic flux density of the regulating pole S1 and a portion of the developer coat amount corresponding to an individual difference of the "local maximum peak position" of magnetic flux density of the regulating pole S1 (see FIG. 12A). Furthermore, in FIG. 11A, a variation of a portion of the developer coat amount corresponding to an individual difference of the "local maximum peak value" of magnetic flux density of the regulating pole S1 is indicated by "$\Delta M_x$", and a variation of a portion of the developer coat amount corresponding to an individual difference of the "local maximum peak position" of magnetic flux density of the regulating pole S1 is indicated by "$\Delta M_y$".

Figure 13A:
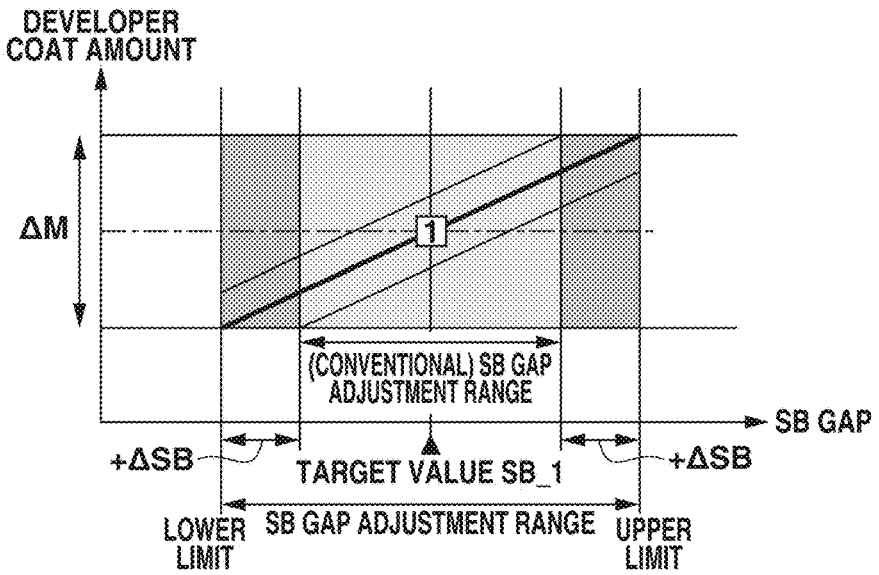
FIGS. 13A, 13B, and 13C are diagrams used to explain a relationship between an adjustment range of the SB gap and the developer coat amount.
Figure 13B:
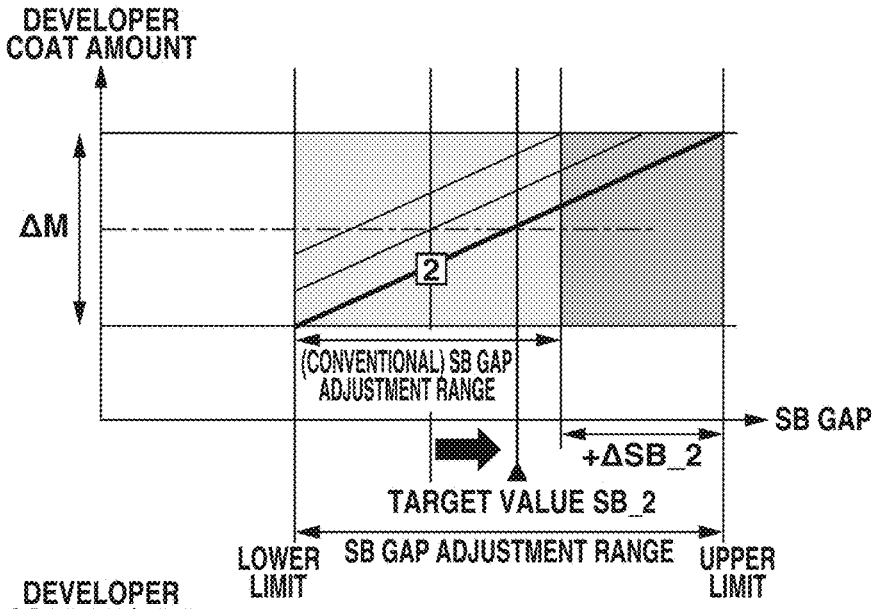
Figure 13C:
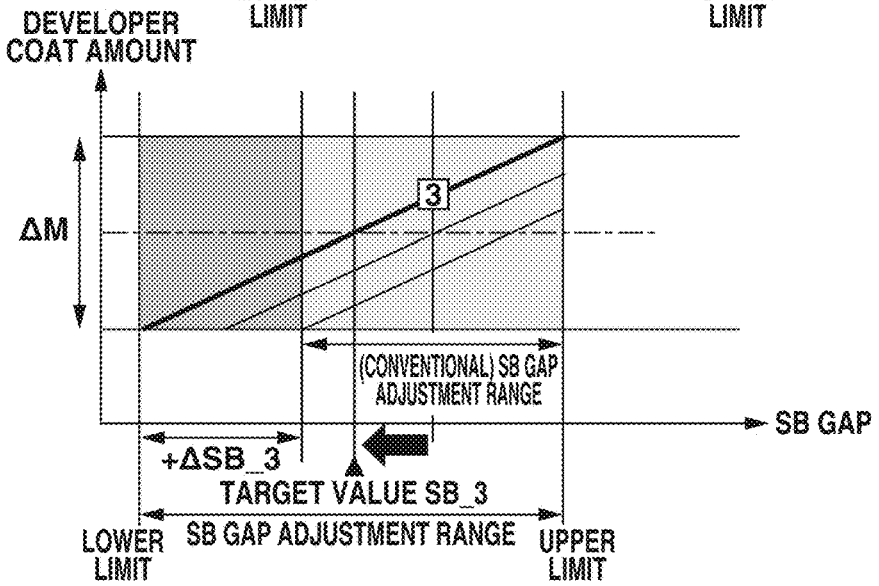

Moreover, in a case where the characteristic of the magnet 71 is the "characteristic line L1", the adjustment range of the SB gap G is able to be broadened up to a range at which the "characteristic line L1" intersects with respective lines of the upper limit value and lower limit value of ΔM (see FIG. 13A).

Figure 11B:
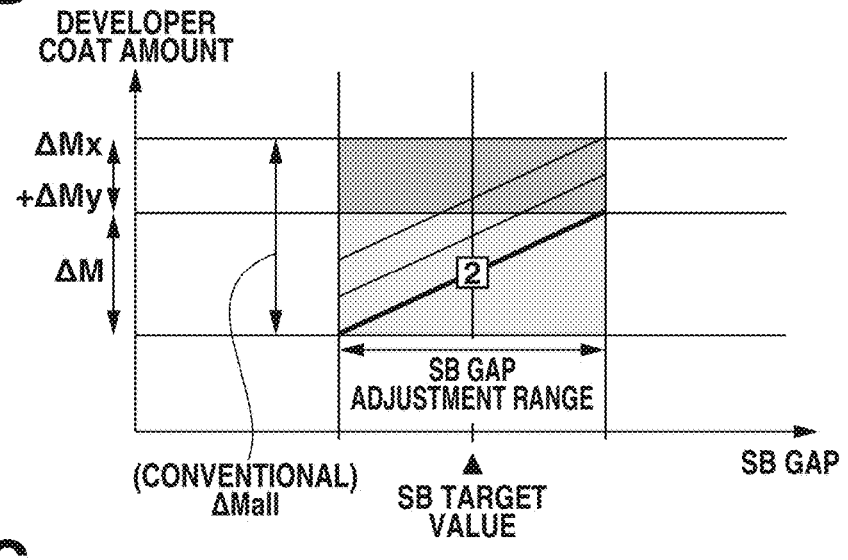

FIG. 11B illustrates a relationship between the adjustment range of the SB gap G and the developer coat amount in a case where the "local maximum peak value" of magnetic flux density of the regulating pole S1 is the lower limit value and the "local maximum peak position" of magnetic flux density of the regulating pole S1 is the lower limit value. In the example illustrated in FIG. 11B, as the characteristic of the magnet 71, the relationship between the size of the SB gap G and the developer coat amount (in other words, the sensitivity of the variation of ΔM to the developer coat amount) is represented by a "characteristic line L2".

Figure 12B:
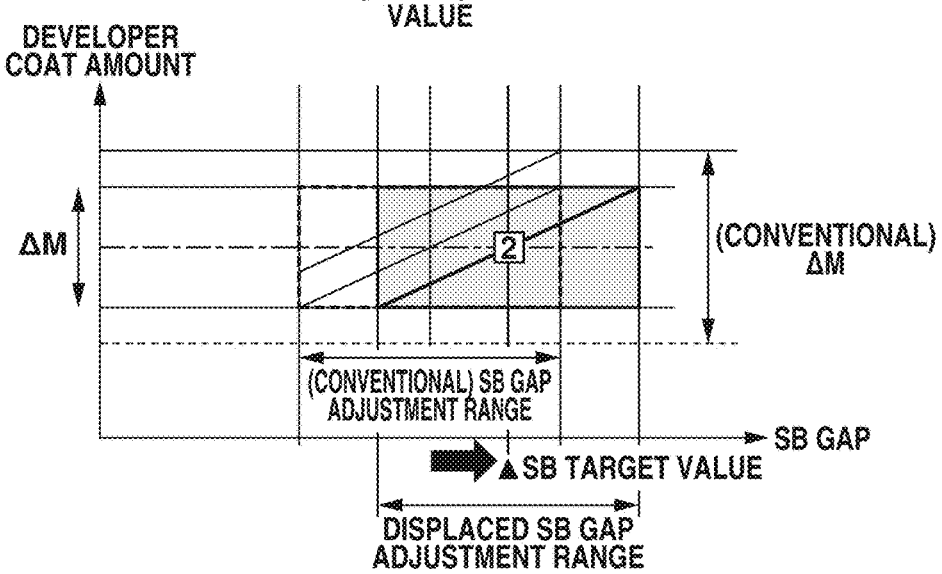

In a case where the characteristic of the magnet 71 is the "characteristic line L2", the "local maximum peak value" of magnetic flux density of the regulating pole S1 shifts to the lower limit value side and the "local maximum peak position" of magnetic flux density of the regulating pole S1 shifts to the lower limit value side (see FIG. 12B). Moreover, in a case where the characteristic of the magnet 71 is the "characteristic line L2", the adjustment range of the SB gap G is able to be broadened up to a range at which the "characteristic line L2" intersects with respective lines of the upper limit value and lower limit value of ΔM (see FIG. 13B). In this case, with the use of the graph of FIG. 13B, the size of the SB gap G corresponding to a target value for the developer coat amount on the "characteristic line L2" can be determined as a target value for the SB gap G.

Figure 11C:
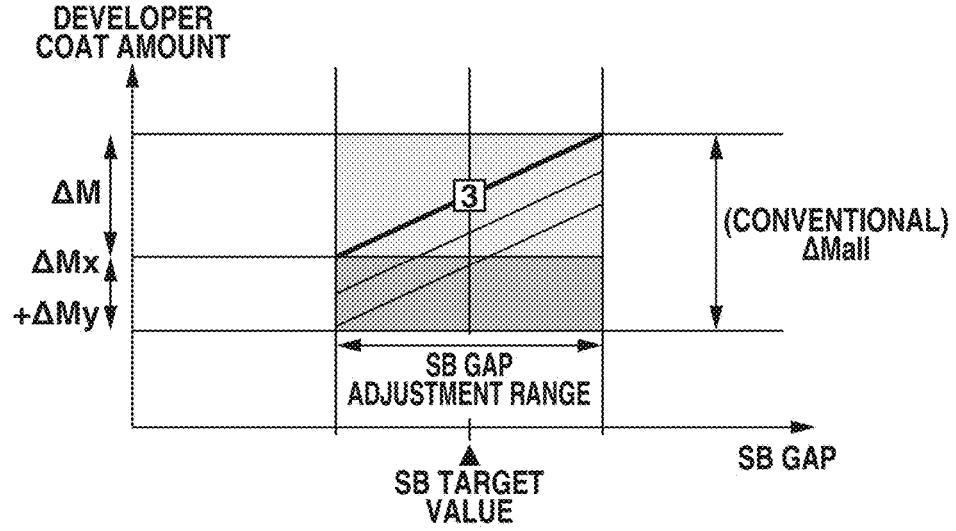

FIG. 11C illustrates a relationship between the adjustment range of the SB gap G and the developer coat amount in a case where the "local maximum peak value" of magnetic flux density of the regulating pole S1 is the upper limit value and the "local maximum peak position" of magnetic flux density of the regulating pole S1 is the upper limit value. In the example illustrated in FIG. 11C, as the characteristic of the magnet 71, the relationship between the size of the SB gap G and the developer coat amount (in other words, the sensitivity of the variation of ΔM to the developer coat amount) is represented by a "characteristic line L3".

Figure 12C:
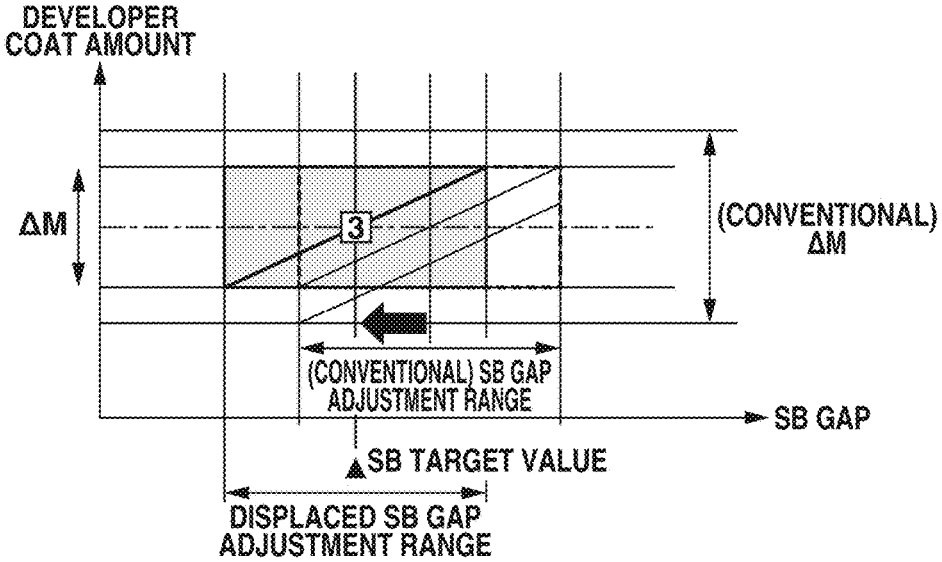

In a case where the characteristic of the magnet 71 is the "characteristic line L3", the "local maximum peak value" of magnetic flux density of the regulating pole S1 shifts to the upper limit value side and the "local maximum peak position" of magnetic flux density of the regulating pole S1 shifts to the upper limit value side (see FIG. 12C). Moreover, in a case where the characteristic of the magnet 71 is the "characteristic line L3", the adjustment range of the SB gap G is able to be broadened up to a range at which the "characteristic line L3" intersects with respective lines of the upper limit value and lower limit value of ΔM (see FIG. 13C). In this case, with the use of the graph of FIG. 13C, the size of the SB gap G corresponding to a target value for the developer coat amount on the "characteristic line L3" can be determined as a target value for the SB gap G.

Furthermore, that the "local maximum peak value" of magnetic flux density of the regulating pole S1 is a center value, a lower limit value, or an upper limit value means that it is a median value, a minimum value, or a maximum value, respectively, in a range of the "local maximum peak value" of magnetic flux density of the regulating pole S1 which is able to be taken for each individual magnet 71. Moreover, that the "local maximum peak position" of magnetic flux density of the regulating pole S1 is a center value, a lower limit value, or an upper limit value means that it is a median value, a minimum value, or a maximum value, respectively, in a range of the "local maximum peak position" of magnetic flux density of the regulating pole S1 which is able to be taken for each individual magnet 71.

In a case where the characteristic of the magnet 71 is the "characteristic line L2" or the "characteristic line L3", the center value of ΔM deviates from that in a case where the characteristic of the magnet 71 is the "characteristic line L1" (see FIGS. 11A to 11C). Therefore, in a case where the size of the SB gap G is set at the same value without consideration for the characteristic of each individual magnet 71, a variation in the developer coat amount would occur for each individual developing device 3. Accordingly, to prevent or reduce a variation in the developer coat amount from occurring for each individual developing device 3, it is necessary to displace a range of the size of the SB gap G for each individual developing device 3 with consideration for the characteristic of the magnet 71.

Accordingly, in a case where the characteristic of the magnet 71 deviates from the center value of ΔM obtained in the case of the "characteristic line L1", the present exemplary embodiment determines the adjustment range of the SB gap G in such a manner that the developer coat amount on the "characteristic line L1" serves as a targeted developer coat amount. As illustrated in FIG. 12B, in a case where the characteristic of the magnet 71 is the "characteristic line L2", the present exemplary embodiment displaces the adjustment range of the SB gap G in such a manner that the center value of the adjustment range of the SB gap G (a target value for the SB gap G) becomes large. On the other hand, as illustrated in FIG. 12C, in a case where the characteristic of the magnet 71 is the "characteristic line L3", the present exemplary embodiment displaces the adjustment range of the SB gap G in such a manner that the center value of the adjustment range of the SB gap G (a target value for the SB gap G) becomes small.

According to FIGS. 11A to 11C, FIGS. 12A to 12C, and FIGS. 13A to 13C described above, it is possible to determine the adjustment range of the SB gap G with consideration for the "local maximum peak value" of magnetic flux density of the regulating pole S1 or the "local maximum peak position" of magnetic flux density of the regulating pole S1 for each individual magnet 71. Furthermore, the method for determining the adjustment range of the SB gap G can include, in addition to making a determination using the characteristic line L1, the characteristic line L2, and the characteristic line L3 such as those illustrated in FIGS. 11A to 11C, FIGS. 12A to 12C, and FIGS. 13A to 13C, making a determination by referring to a table that is able to be converted into the adjustment range of the SB gap G.

<Method for Fixing Regulating Blade>

As mentioned above, the cause of a variation (ΔM) of the developer coat amount is that a variation occurring in the "local maximum peak value" or the "local maximum peak position" of magnetic flux density of the regulating pole S1 for each individual magnet 71 brings about a variation in the distribution of magnitudes of magnetic forces in the vicinity of the regulating pole S1.

Accordingly, the method calculates an actual measured value of the "local maximum peak value" or the "local maximum peak position" of magnetic flux density of the regulating pole S1 for each individual magnet 71, and records, on the developing sleeve 70, information about the "local maximum peak value" or the "local maximum peak position" of magnetic flux density of the regulating pole S1 with use of a two-dimensional barcode. Then, when fixing the regulating blade 36 to the developing frame member 30, the apparatus reads the two-dimensional barcode provided on the developing sleeve 70 to acquire (input) information about the "local maximum peak value" or the "local maximum peak position" of magnetic flux density of the regulating pole S1 recorded on the developing sleeve 70. Next, the apparatus determines the adjustment range of the SB gap G based on the information about the "local maximum peak value" or the "local maximum peak position" of magnetic flux density of the regulating pole S1 recorded on the developing sleeve 70. Then, the apparatus fixes the regulating blade 36 to the developing frame member 30 in such a manner that the size of the SB gap G falls within the determined adjustment range of the SB gap G (in other words, between the upper limit value and the lower limit value of the SB gap G)) over the longitudinal direction of the developing sleeve 70. Details thereof are described as follows.

Figure 14:
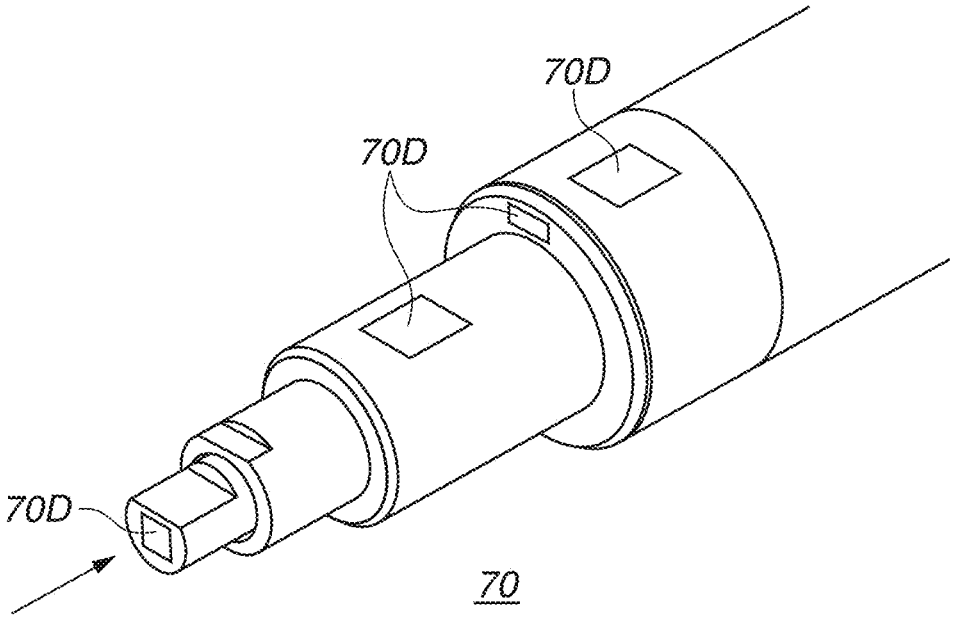
FIG. 14 is a diagram used to explain a portion at which a two-dimensional barcode of a developing sleeve is provided.

First, a portion of the developing sleeve 70 at which the two-dimensional barcode is provided is described with reference to FIG. 14. FIG. 14 is a diagram illustrating an end portion in the longitudinal direction of the developing sleeve 70 in an enlarged manner.

In the first exemplary embodiment, a two-dimensional barcode is used as a method for recording, on the developing sleeve 70, information about the "local maximum peak value" or the "local maximum peak position" of magnetic flux density of the regulating pole S1. The portion of the developing sleeve 70 at which the two-dimensional barcode is provided only needs to be a portion at which the apparatus is able to read the two-dimensional barcode in the state in which the developing sleeve 70 is supported by the developing frame member 30. For example, the portion (70*d*) of the developing sleeve 70 at which the two-dimensional barcode is provided is an end portion in the longitudinal direction of a shaft portion for magnet (a magnet shaft) for fixing the magnet 71 to the inside of the developing sleeve 70. Furthermore, the magnet shaft is one of components consisting of the developing sleeve 70. Moreover, for example, the portion (70*d*) of the developing sleeve 70 at which the two-dimensional barcode is provided can be a flange portion which is located at an end portion in the longitudinal direction of the developing sleeve 70 and is rotatable integrally with the developing sleeve 70.

Furthermore, a modification example of calculating an actual measured value of the local maximum peak value or the local maximum peak position of magnetic flux density of the regulating pole S1 for each individual magnet 71 and recording, on the magnet 71, information about the local maximum peak value or the local maximum peak position of magnetic flux density of the regulating pole S1 with use of a two-dimensional barcode can also be employed. In this modification example, for example, the magnet 71 is fixedly located inside the developing sleeve 70 and the apparatus reads the two-dimensional barcode of the magnet 71 in the state in which a flange portion is attached to one end portion in the longitudinal direction of the developing sleeve 70. Then, after the apparatus reads the two-dimensional barcode of the magnet 71, a flange portion is attached to the other end portion in the longitudinal direction of the developing sleeve 70, and, after that, the developing sleeve 70 can be supported by the developing frame member 30. The portion of the magnet 71 at which the two-dimensional barcode is provided only needs to be a portion at which the apparatus is able to read the two-dimensional barcode in the state in which the magnet 71 is fixedly located inside the developing sleeve 70 and the flange portion is attached to one end portion in the longitudinal direction of the developing sleeve 70.

In the first exemplary embodiment, an actual measured value of the "local maximum peak value" of magnetic flux density of the regulating pole S1 or an actual measured value of the "local maximum peak position" of magnetic flux density of the regulating pole S1 is recorded on the developing sleeve 70 with use of a two-dimensional barcode. Furthermore, the "local maximum peak position" of magnetic flux density of the regulating pole S1 can be calculated by measuring an angle from a phase determination portion for determining the phase of the magnet 71. The phase determination portion is provided at an end portion in the longitudinal direction of a shaft portion for magnet for fixing the magnet 71 to the inside of the developing sleeve 70.

The apparatus reads a two-dimensional barcode provided on the developing sleeve 70 to acquire information about the "local maximum peak value" or the "local maximum peak position" of magnetic flux density of the regulating pole S1 included in the magnet 71 fixedly located inside the developing sleeve 70. Then, the apparatus associates the information about the "local maximum peak value" or the "local maximum peak position" of magnetic flux density of the regulating pole S1 acquired from the developing sleeve 70 with a unit in which the developing sleeve 70 is supported by the developing frame member 30.

Furthermore, it is desirable that reading by the apparatus of the two-dimensional barcode provided on the developing sleeve 70 be performed in the state of a unit in which the developing sleeve 70 is supported by the developing frame member 30. This is to prevent an error of the association between a unit in which the developing sleeve 70 is supported by the developing frame member 30 and information about the "local maximum peak value" or the "local maximum peak position" of magnetic flux density of the regulating pole S1.

Here, consider the case of adjusting the size of the SB gap G at each of both end portions and a central portion in the longitudinal direction of a maximum image region of the developing sleeve 70. In this case, information about the "local maximum peak value" or the "local maximum peak position" of magnetic flux density of the regulating pole S1 at each of both end portions and a central portion in the longitudinal direction of the magnet 71 can be recorded on the developing sleeve 70 with use of a two-dimensional barcode. In other words, in conformity with a condition used at the time of adjustment of the SB gap G, information about the "local maximum peak value" or the "local maximum peak position" of magnetic flux density of the regulating pole S1 at each of a plurality of portions in the longitudinal direction of the magnet 71 can be recorded on the developing sleeve 70 with use of a two-dimensional barcode.

Figure 15:
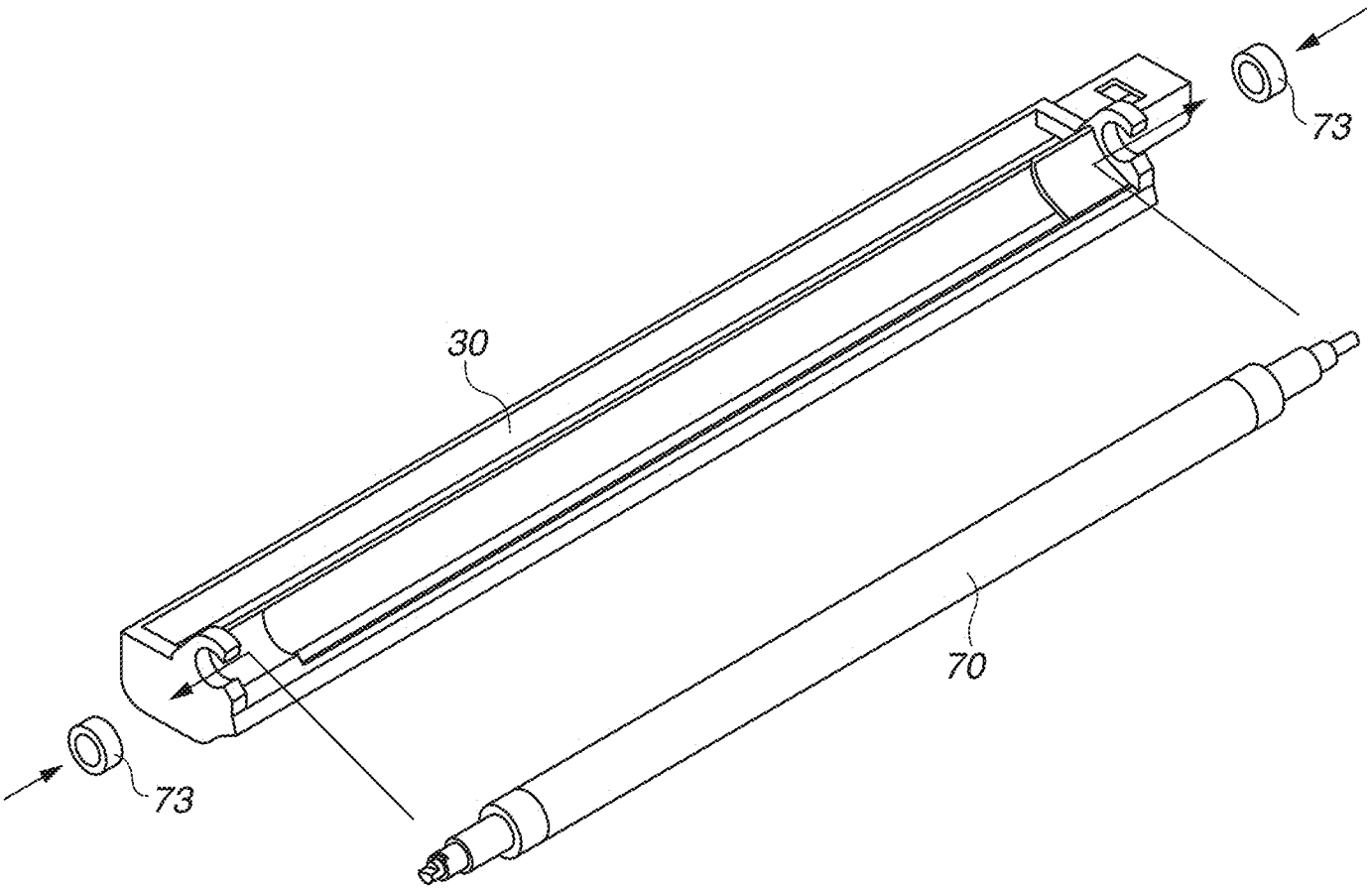
FIG. 15 is a diagram used to explain a process of attaching the developing sleeve to a developing frame member.

Next, a process of attaching the developing sleeve 70 to the developing frame member 30 is described with reference to FIG. 15. As illustrated in FIG. 15, before the regulating blade 36 is fixed to the developing frame member 30, the developing sleeve 70 on which a two-dimensional barcode is provided is previously attached to the developing frame member 30. This enables calculating the size of the SB gap G in the state in which the developing sleeve 70 is supported by the developing frame member 30.

Next, a process of acquiring, from the developing sleeve 70, a characteristic of the magnet 71 fixedly located inside the developing sleeve 70 is described with reference to FIG. 16.

Figure 16:
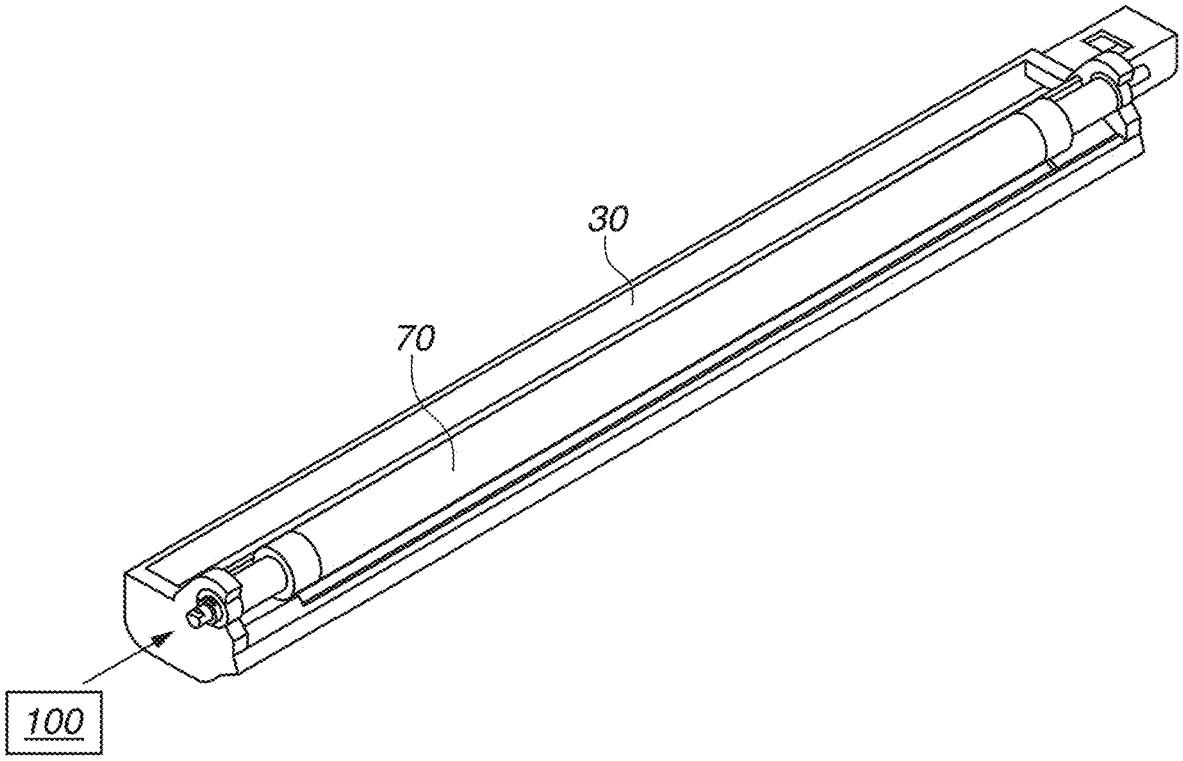
FIG. 16 is a diagram used to explain a process of acquiring the characteristics of a magnet from the developing sleeve.

As illustrated in FIG. 16, in the state in which the developing sleeve 70 is attached to the developing frame member 30, the apparatus 100 reads a two-dimensional barcode provided on the developing sleeve 70 to acquire information about the "local maximum peak value" or the "local maximum peak position" of magnetic flux density of the regulating pole S1.

Next, the apparatus 100 determines the size of the SB gap G which is targeted to adjust the size of the SB gap G, based on information about the "local maximum peak value" or the "local maximum peak position" of magnetic flux density of the regulating pole S1 acquired from the developing sleeve 70. Specifically, the apparatus 100 specifies a characteristic of the magnet 71 (the characteristic line L1, the characteristic line L2, or the characteristic line L3 mentioned above with reference to FIGS. 11A to 11C) based on information about the "local maximum peak value" or the "local maximum peak position" of magnetic flux density of the regulating pole S1 acquired from the developing sleeve 70. Then, the apparatus 100 determines the size of the SB gap G corresponding to a target value for the developer coat amount on the characteristic line, as a target value for the size of the SB gap G, based on the characteristic of the magnet 71 (the characteristic line L1, the characteristic line L2, or the characteristic line L3). Then, the apparatus 100 prevents or reduces a variation in the developer coat amount (ΔM) for each individual developing device 3 by adjusting the upper limit value and the lower limit value serving as an adjustment range of the SB gap G.

Next, a fixing process of fixing the regulating blade 36 to the developing frame member 30 is described with reference to FIGS. 17A and 17B.

Figure 17A:
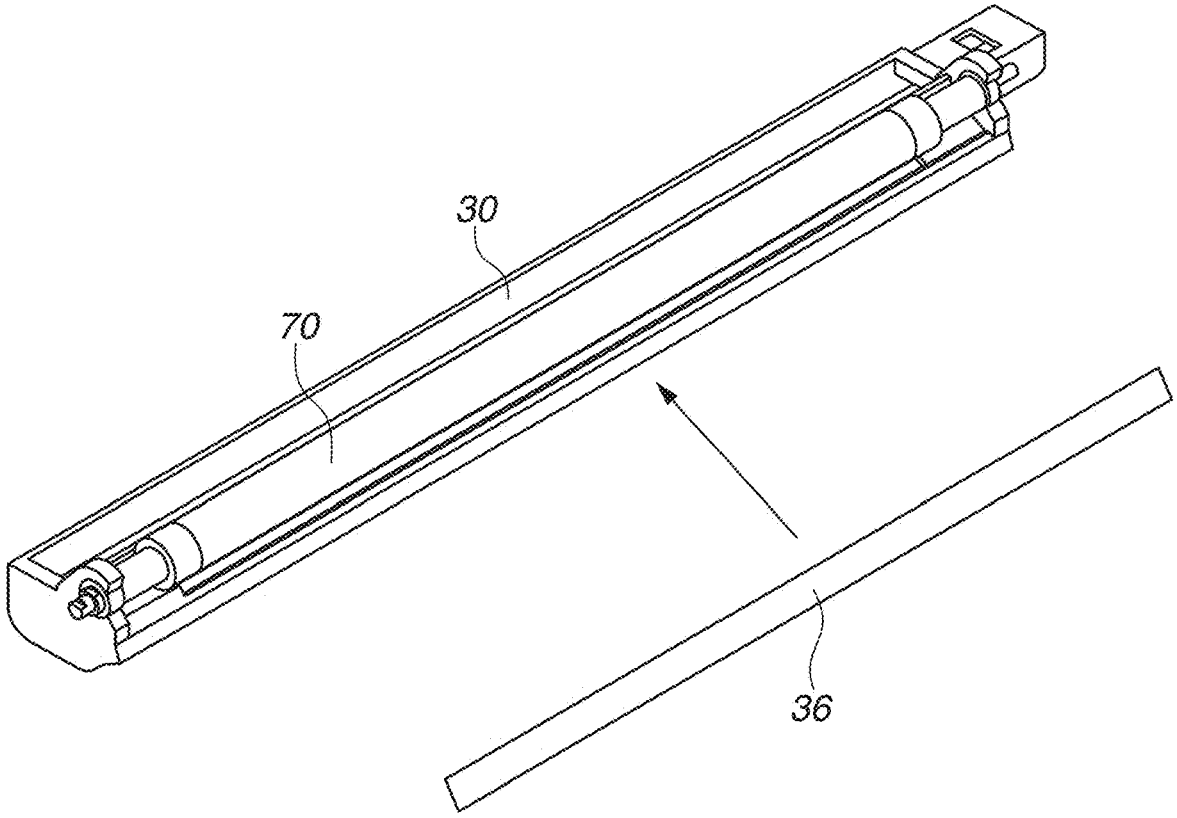
FIGS. 17A and 17B are diagrams used to explain a process of fixing the regulating blade to the developing frame member.
Figure 17B:
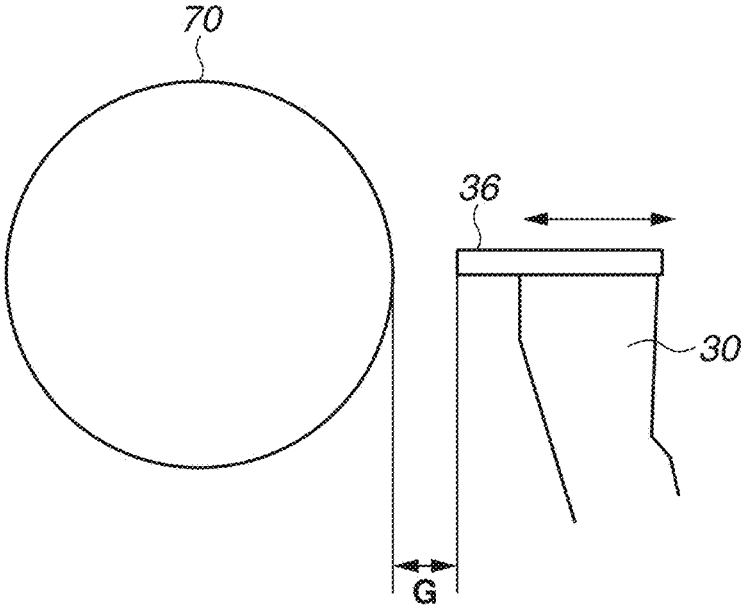

As illustrated in FIGS. 17A and 17B, the apparatus adjusts a position at which to fix the regulating blade 36 to the developing frame member 30 in such a manner that the size of the SB gap G falls within the determined adjustment range of the SB gap G. For example, while observing an end portion in the longitudinal direction of the maximum image region of the developing sleeve 70 and an end portion in the longitudinal direction of the regulating blade 36 via, for example, a sensor (a camera or a laser device), the apparatus moves the regulating blade 36 in such a manner that the size of the SB gap G falls within the adjustment range of the SB gap G. Furthermore, instead of an example of measuring the size of the SB gap G via, for example, a sensor, a method of measuring the size of the SB gap G by causing, for example, a gapper to strike the SB gap G can be employed. Then, when the size of the SB gap G has fallen within a predetermined range, the apparatus fixes the regulating blade 36 to the developing frame member 30.

More specifically, suppose that the SB gap G calculated at an initial position in which the regulating blade 36 has been landed on the developing frame member 30 is 350 μm. On the other hand, suppose that the adjustment range of the SB gap G is 300 μm±30 μm, and up to 60 μm is acceptable as the tolerance of the SB gap G (in other words, the tolerance of a target value for the SB gap G). In this case, in the initial position in which the regulating blade 36 has been landed on the developing frame member 30, the adjustment range of the SB gap G is 50 μm larger than 300 μm, which is a nominal value of the SB gap G. Accordingly, while grasping the regulating blade 36 with a finger, the apparatus translates the regulating blade 36 in a direction to move the regulating blade 36 closer to the surface of the developing sleeve 70 by 50 μm.

Then, the camera reads a position that is closest to the regulating blade 36 translated by the finger and a leading end portion of the regulating blade 36 translated by the finger. Next, the apparatus re-calculates the SB gap G with respect to the regulating blade 36 translated by the finger.

When determining that the calculated size of the SB gap G falls within the range of adjustment values of the SB gap G (300 μm±30 μm), the apparatus ends the adjustment of the SB gap G. On the other hand, when determining that the calculated size of the SB gap G does not fall within the adjustment rang of the SB gap G (300 μm±30 μm), the apparatus repeats the above-mentioned adjustment of the SB gap G until the calculated size of the SB gap G falls within the adjustment rang of the SB gap G (300 μm±30 μm). In this way, in the state in which the size of the SB gap G is set in a predetermined range (the range of adjustment values of the SB gap G), the apparatus fixes the regulating blade 36 to the developing frame member 30.

Furthermore, in the first exemplary embodiment, an example in which, when the size of the SB gap G is adjusted, both the "local maximum peak value" of magnetic flux density of the regulating pole S1 and the "local maximum peak position" of magnetic flux density of the regulating pole S1 are taken into consideration has been described. On the other hand, the phase of the magnet 71 is determined by attaching a phase fixing member to a phase fixing portion provided at an end portion in the longitudinal direction of the developing sleeve 70 (an end portion in the longitudinal direction of a shaft portion for magnet). Therefore, a deviation of the phase (angular deviation) of the magnet 71 from the regulating blade 36 occurs due to an angular deviation component of the regulating pole S1 from the phase fixing portion of the magnet 71, a component tolerance of the phase fixing member, and a tolerance of a fixing portion for fixing the regulating blade 36 to the developing frame member 30.

Accordingly, the local maximum peak position of magnetic flux density of the regulating pole S1 can be regarded as a specific position, and, as a variation of the characteristic for each individual magnet 71, only the "local maximum peak value" of magnetic flux density of the regulating pole S1 can be taken into consideration without consideration for the "local maximum peak position" of magnetic flux density of the regulating pole S1. In this case, it is possible to reduce the amount of information to be recorded on the developing sleeve 70 as the characteristic of the magnet 71 fixed to the inside of the developing sleeve 70. As long as it is possible to reduce the amount of information to be recorded on the developing sleeve 70, the method of recording the characteristic of the magnet 71 on the developing sleeve 70 is not limited to a two-dimensional barcode. For example, information about the "local maximum peak value" of magnetic flux density of the regulating pole S1 can be directly recorded on the developing sleeve 70 by, for example, engraving, printing, or typing, for example, numerals, characters, or symbols. Furthermore, in a modification example in which information about the local maximum peak value of magnetic flux density of the regulating pole S1 is directly recorded on, for example, the developing sleeve 70 or the magnet 71 by, for example, engraving, printing, or typing, for example, numerals, characters, or symbols, consider a case where the user is able to visually recognize the local maximum peak value of magnetic flux density of the regulating pole S1. In this case, the user only needs to directly input the visually recognized local maximum peak value of magnetic flux density of the regulating pole S1 to an operation unit of the apparatus, and, therefore, a reading unit for reading a two-dimensional barcode does not need to be provided in the apparatus, so that the apparatus can be simplified in configuration.

Likewise, the local maximum peak value of magnetic flux density of the regulating pole S1 can be regarded as a specific value, and, as a variation of the characteristic for each individual magnet 71, only the "local maximum peak position" of magnetic flux density of the regulating pole S1 can be taken into consideration without consideration for the "local maximum peak value" of magnetic flux density of the regulating pole S1. In this case, it is possible to reduce the amount of information to be recorded on the developing sleeve 70 as the characteristic of the magnet 71 fixed to the inside of the developing sleeve 70. As long as it is possible to reduce the amount of information to be recorded on the developing sleeve 70, the method of recording the characteristic of the magnet 71 on the developing sleeve 70 is not limited to a two-dimensional barcode. For example, information about the "local maximum peak position" of magnetic flux density of the regulating pole S1 can be directly recorded on the developing sleeve 70 by, for example, engraving, printing, or typing, for example, numerals, characters, or symbols. Furthermore, in a modification example in which information about the "local maximum peak position" of magnetic flux density of the regulating pole S1 is directly recorded on, for example, the developing sleeve 70 or the magnet 71 by, for example, engraving, printing, or typing, for example, numerals, characters, or symbols, consider a case where the user is able to visually recognize the local maximum peak position of magnetic flux density of the regulating pole S1. In this case, the user only needs to directly input the visually recognized local maximum peak position of magnetic flux density of the regulating pole S1 to an operation unit of the apparatus, and, therefore, a reading unit for reading a two-dimensional barcode does not need to be provided in the apparatus, so that the apparatus can be simplified in configuration.

However, when the target size of the SB gap G is adjusted, the effect of preventing or reducing a variation of ΔM is larger in a case where both the "local maximum peak value" and the "local maximum peak position" of magnetic flux density of the regulating pole S1 are taken into consideration than in a case where only one of them is taken into consideration. Therefore, if making the effect of preventing or reducing a variation in the developer coat amount (ΔM) is prioritized over reducing the amount of information to be recorded on the developing sleeve 70, both the "local maximum peak value" and the "local maximum peak position" of magnetic flux density of the regulating pole S1 can be taken into consideration.

In the above-described first aspect of the present invention, information about the "local maximum peak value" of magnetic flux density of the regulating pole S1 of the magnet 71 fixedly located inside the developing sleeve 70 is recorded on the developing sleeve 70. Then, when the regulating blade 36 is fixed to the developing frame member 30, information about the "local maximum peak value" of magnetic flux density of the regulating pole S1 recorded on the developing sleeve 70 is acquired by reading a two-dimensional barcode provided on the developing sleeve 70. Next, the regulating blade 36 is fixed to the developing frame member 30 in such a manner that the size of the SB gap G falls within a predetermined range corresponding to the "local maximum peak value" of magnetic flux density of the regulating pole S1 recorded on the developing sleeve 70 over the longitudinal direction of the developing sleeve 70. According to the first aspect of the present invention as described above, adjusting the size of the SB gap G with consideration for the "local maximum peak value" of magnetic flux density of the regulating pole S1 included in the magnet 71 enables preventing or reducing a variation in the developer coat amount for each individual developing device 3.

Moreover, in the above-described second aspect of the present invention, information about the "local maximum peak position" of magnetic flux density of the regulating pole S1 of the magnet 71 fixedly located inside the developing sleeve 70 is recorded on the developing sleeve 70. Then, when the regulating blade 36 is fixed to the developing frame member 30, information about the "local maximum peak position" of magnetic flux density of the regulating pole S1 recorded on the developing sleeve 70 is acquired by reading a two-dimensional barcode provided on the developing sleeve 70. Next, the regulating blade 36 is fixed to the developing frame member 30 in such a manner that the size of the SB gap G falls within a predetermined range corresponding to the "local maximum peak position" of magnetic flux density of the regulating pole S1 recorded on the developing sleeve 70 over the longitudinal direction of the developing sleeve 70. According to the second aspect of the present invention as described above, adjusting the size of the SB gap G with consideration for the "local maximum peak position" of magnetic flux density of the regulating pole S1 included in the magnet 71 enables preventing or reducing a variation in the developer coat amount for each individual developing device 3.

In the above-described first aspect of the present invention, an example in which the information to be recorded on the developing sleeve 70 is information about the "local maximum peak value" of magnetic flux density of the regulating pole S1 of the magnet 71 fixedly located inside the developing sleeve 70 has been described. Moreover, in the above-described second aspect of the present invention, an example in which the information to be recorded on the developing sleeve 70 is information about the "local maximum peak position" of magnetic flux density of the regulating pole S1 of the magnet 71 fixedly located inside the developing sleeve 70 has been described. On the other hand, in a second exemplary embodiment, an example in which the information to be recorded on the developing sleeve 70 is information about the size of the SB gap G which is targeted to adjust the size of the SB gap G is described as follows.

In the second exemplary embodiment, an actual measured value of the "local maximum peak value" of magnetic flux density of the regulating pole S1 for each individual magnet 71 is calculated. Next, the size of the SB gap G which is targeted to adjust the size of the SB gap G is previously determined based on the calculated "local maximum peak value" of magnetic flux density of the regulating pole S1. Then, the adjustment range of the SB gap G (a target value for the SB gap G) corresponding to the "local maximum peak value" of magnetic flux density of the regulating pole S1 is recorded on the developing sleeve 70.

Likewise, an actual measured value of the "local maximum peak position" of magnetic flux density of the regulating pole S1 for each individual magnet 71 is calculated. Next, the size of the SB gap G which is targeted to adjust the size of the SB gap G is previously determined based on the calculated "local maximum peak position" of magnetic flux density of the regulating pole S1. Then, the adjustment range of the SB gap G (a target value for the SB gap G) corresponding to the "local maximum peak position" of magnetic flux density of the regulating pole S1 is recorded on the developing sleeve 70.

However, when the target size of the SB gap G is adjusted, the effect of preventing or reducing a variation of ΔM is larger in a case where both the "local maximum peak value" and the "local maximum peak position" of magnetic flux density of the regulating pole S1 are taken into consideration than in a case where only one of them is taken into consideration. Accordingly, a more desirable example is as follows. Specifically, respective actual measured values of the "local maximum peak value" and the "local maximum peak position" of magnetic flux density of the regulating pole S1 for each individual magnet 71 are calculated. Next, the size of the SB gap G which is targeted to adjust the size of the SB gap G is previously determined based on the calculated "local maximum peak value" and the calculated "local maximum peak position" of magnetic flux density of the regulating pole S1. Then, the adjustment range of the SB gap G (a target value for the SB gap G) corresponding to the "local maximum peak value" and the "local maximum peak position" of magnetic flux density of the regulating pole S1 is recorded on the developing sleeve 70.

Here, consider the case of adjusting the size of the SB gap G at each of both end portions and a central portion in the longitudinal direction of a maximum image region of the developing sleeve 70. In this case, information about the adjustment range of the SB gap G (a target value for the SB gap G) at each of both end portions and a central portion in the longitudinal direction of a maximum image region of the developing sleeve 70 can be recorded on the developing sleeve 70. In other words, in conformity with a condition used at the time of adjustment of the SB gap G, information about the adjustment range of the SB gap G (a target value for the SB gap G) at each of a plurality of portions in the longitudinal direction of a maximum image region of the developing sleeve 70 can be recorded on the developing sleeve 70.

In the second exemplary embodiment, the developing sleeve 70 on which the adjustment range of the SB gap G (a target value for the SB gap G) is recorded is attached to the developing frame member 30. Then, the apparatus 100 acquires the adjustment range of the SB gap G (a target value for the SB gap G) recorded on the developing sleeve 70 supported by the developing frame member 30. Then, the apparatus 100 adjusts a position at which to fix the regulating blade 36 to the developing frame member 30 in such a manner that the size of the SB gap G falls within the acquired adjustment range of the SB gap G, and fixes the regulating blade 36 to the developing frame member 30.

In the second exemplary embodiment described above, instead of information about the "local maximum peak value" or the "local maximum peak position" of magnetic flux density of the regulating pole S1 being recorded on the developing sleeve 70, the adjustment range of the SB gap G (a target value for the SB gap G) only needs to be recorded on the developing sleeve 70. Therefore, in the second exemplary embodiment, it is possible to reduce the amount of information to be recorded on the developing sleeve 70 as compared with the first exemplary embodiment. As long as it is possible to reduce the amount of information to be recorded on the developing sleeve 70, the method of recording the data on the developing sleeve 70 is not limited to a two-dimensional barcode, and the adjustment range of the SB gap G (a target value for the SB gap G) can be directly recorded on the developing sleeve 70 by, for example, engraving, printing, or typing.

In the second exemplary embodiment, an example in which the information to be recorded on the developing sleeve 70 is the adjustment range of the SB gap G (a target value for the SB gap G) has been described. On the other hand, in a third exemplary embodiment, an example in which the information to be recorded on the developing sleeve 70 is information about a rank of the size of the SB gap G which is targeted to adjust the size of the SB gap G is described as follows.

Table 1 shows ranks of the size of the SB gap G which is targeted to adjust the size of the SB gap G, with two levels of ranks. The two levels of ranks are determined based on the "local maximum peak value" of magnetic flux density of the regulating pole S1 or the "local maximum peak position" of magnetic flux density of the regulating pole S1.

Table 2 shows ranks of the size of the SB gap G which is targeted to adjust the size of the SB gap G, with four levels of ranks. The four levels of ranks are determined based on the "local maximum peak value" of magnetic flux density of the regulating pole S1 or the "local maximum peak position" of magnetic flux density of the regulating pole S1.

TABLE 1

| Rank A | Rank B |
|---|---|
| SB A | SB B |

TABLE 2

| | | Local maximum peak position of magnetic flux density | |
|---|---|---|---|
| | | Rank A | Rank B |
| Local maximum peak value of magnetic flux density | Rank A | SB AA | SB AB |
| | Rank B | SB BA | SB BB |

With respect to a variation of the characteristic for each individual magnet 71, in the case of adjusting the size of the SB gap G with consideration for any one of the "local maximum peak value" of magnetic flux density of the regulating pole S1 and the "local maximum peak position" of magnetic flux density of the regulating pole S1, Table 1 can be used. On the other hand, with respect to a variation of the characteristic for each individual magnet 71, in the case of adjusting the size of the SB gap G with consideration for both the "local maximum peak value" of magnetic flux density of the regulating pole S1 and the "local maximum peak position" of magnetic flux density of the regulating pole S1, Table 2 can be used.

Figure 18A:
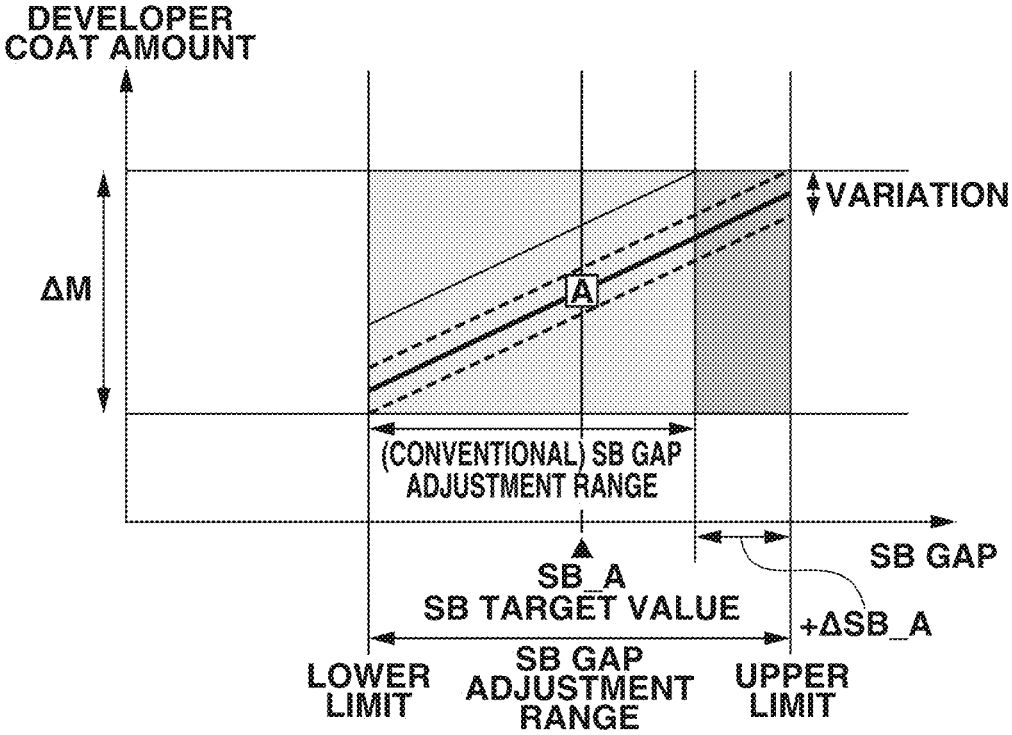
FIGS. 18A and 18B are diagrams used to explain a relationship between an adjustment range of the SB gap and the developer coat amount.
Figure 18B:
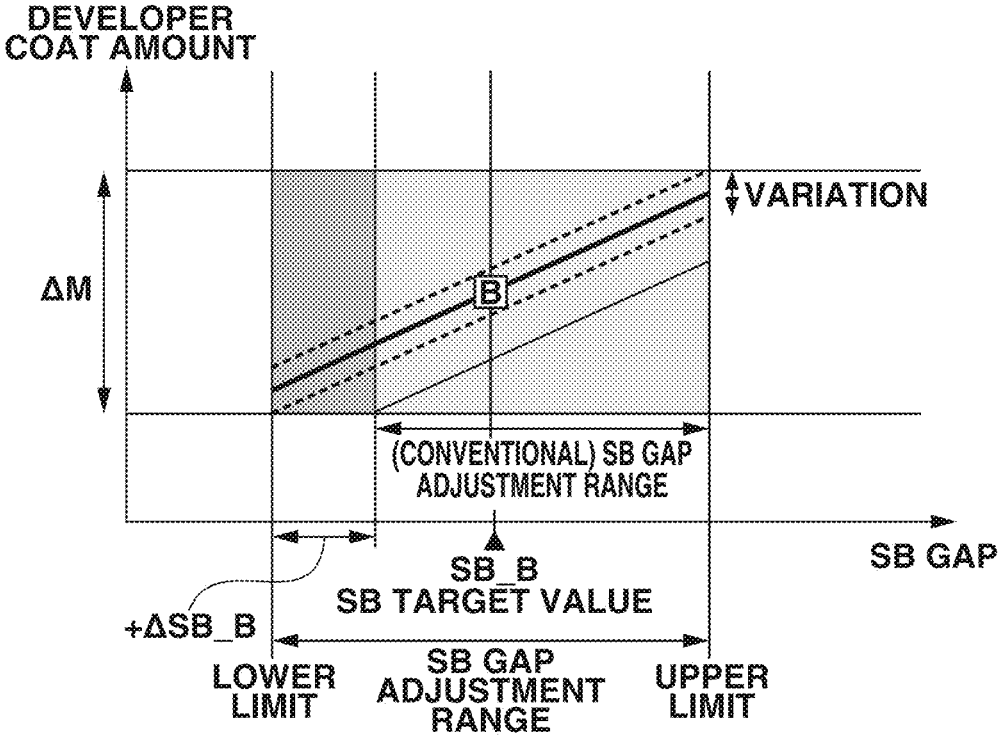

Here, a relationship between the adjustment range of the SB gap G and the developer coat amount is described with reference to FIGS. 18A and 18B. FIGS. 18A and 18B illustrate the usage of two levels of ranks shown in Table 1 as ranks of the size of the SB gap G which is targeted to adjust the size of the SB gap G.

As illustrated in FIGS. 18A and 18B, the lower limit value of the adjustment range of the SB gap G is assumed to be "rank A" and the upper limit value of the adjustment range of the SB gap G is assumed to be "rank B".

FIG. 18A illustrates a relationship between the adjustment range of the SB gap G and the developer coat amount in a case where the "local maximum peak value" of magnetic flux density of the regulating pole S1 is "rank A" and the "local maximum peak position" of magnetic flux density of the regulating pole S1 is "rank A".

FIG. 18B illustrates a relationship between the adjustment range of the SB gap G and the developer coat amount in a case where the "local maximum peak value" of magnetic flux density of the regulating pole S1 is "rank B" and the "local maximum peak position" of magnetic flux density of the regulating pole S1 is "rank B".

In the third exemplary embodiment, actual measured values of the "local maximum peak value" and the "local maximum peak position" of magnetic flux density of the regulating pole S1 are calculated for each individual magnet 71. Next, a rank of the size of the SB gap G which is targeted to adjust the size of the SB gap is previously determined based on the calculated "local maximum peak value" and the calculated "local maximum peak position" of magnetic flux density of the regulating pole S1. Then, the determined rank of the size of the SB gap G is recorded on the developing sleeve 70.

Moreover, in the third exemplary embodiment, the developing sleeve 70 on which the rank of the size of the SB gap G is recorded is attached to the developing frame member 30. Then, the apparatus 100 acquires the rank of the size of the SB gap G recorded on the developing sleeve 70 supported by the developing frame member 30. Then, the apparatus 100 adjusts a position at which to fix the regulating blade 36 to the developing frame member 30 in such a manner that the size of the SB gap G falls within the adjustment range of the SB gap G corresponding to the acquired rank of the size of the SB gap G, and fixes the regulating blade 36 to the developing frame member 30.

In the third exemplary embodiment described above, instead of information about the "local maximum peak value" or the "local maximum peak position" of magnetic flux density of the regulating pole S1 being recorded on the developing sleeve 70, the rank of the size of the SB gap G only needs to be recorded on the developing sleeve 70. Therefore, in the third exemplary embodiment, it is possible to reduce the amount of information to be recorded on the developing sleeve 70 as compared with the first exemplary embodiment. As long as it is possible to reduce the amount of information to be recorded on the developing sleeve 70, the method of recording the data on the developing sleeve 70 is not limited to a two-dimensional barcode. Specifically, for example, numerals, characters, or symbols representing the rank of the size of the SB gap G can be directly recorded on the developing sleeve 70 by, for example, engraving, printing, or typing.

However, in the third exemplary embodiment, a variation of ΔM is likely to remain for each rank as compared with the first exemplary embodiment in which the range of the size of the SB gap G is determined with consideration for an actual measured value of the "local maximum peak value" or the "local maximum peak position" of magnetic flux density of the regulating pole S1. Therefore, in the third exemplary embodiment, the degree of the effect of feeding back a variation of the characteristic of the magnet 71 as the range of the size of the SB gap G becomes smaller than in the first exemplary embodiment. Accordingly, if making the effect of preventing or reducing a variation in the developer coat amount (ΔM) is prioritized over reducing the amount of information to be recorded on the developing sleeve 70, levels for ranking the size of the SB gap G can be more finely set.

In a fourth exemplary embodiment, a more favorable example for performing adjustment of the SB gap G with a higher degree of accuracy is described.

The cause of variation of the developer coat amount during driving of the developing device 3 includes a deflection of the outer diameter of the developing sleeve 70. Therefore, in the fourth exemplary embodiment, the adjustment of the SB gap G is performed with a higher degree of accuracy by taking into consideration the straightness of the surface of the developing sleeve 70 (in other words, a deflection of the outer diameter of the developing sleeve 70) in addition to taking into consideration a variation of the characteristic for each individual magnet 71.

Since a sleeve tube which constitutes the outer shell of the developing sleeve 70 is made from metal, performing secondary cutting work on the sleeve tube enables the straightness of the surface of the developing sleeve 70 to have a high accuracy of, for example, ±15 μm or less. However, in the case of the rotational state of the developing sleeve 70 in actual use, the straightness of ±15 μm of the developing sleeve 70 is grasped as if the outer diameter of the developing sleeve 70 is apparently varying by ±15 μm. Accordingly, in the rotational state of the developing sleeve 70, in order to minimize the impact on the SB gap G caused by the straightness of the surface of the developing sleeve 70, it is effective to measure the SB gap G while rotating the developing sleeve 70.

Here, a deflection of the outer diameter of the developing sleeve 70 is described with reference to FIGS. 19A, 19B, and 19C.

Figure 19A:
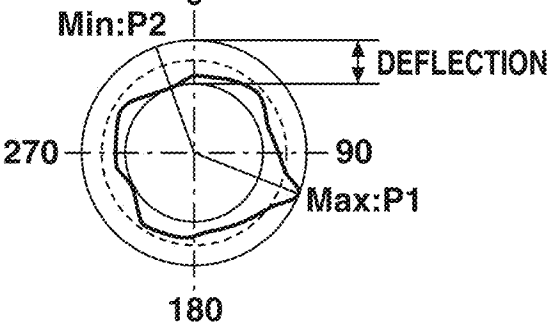
FIGS. 19A, 19B, and 19C are diagrams used to explain a deflection of the outer diameter of the developing sleeve.
Figure 19B:
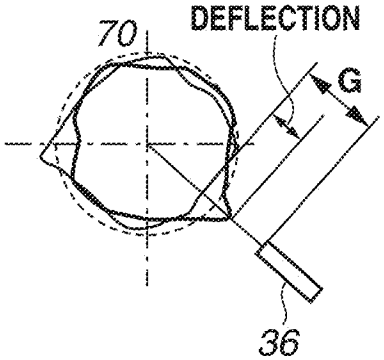
Figure 19C:
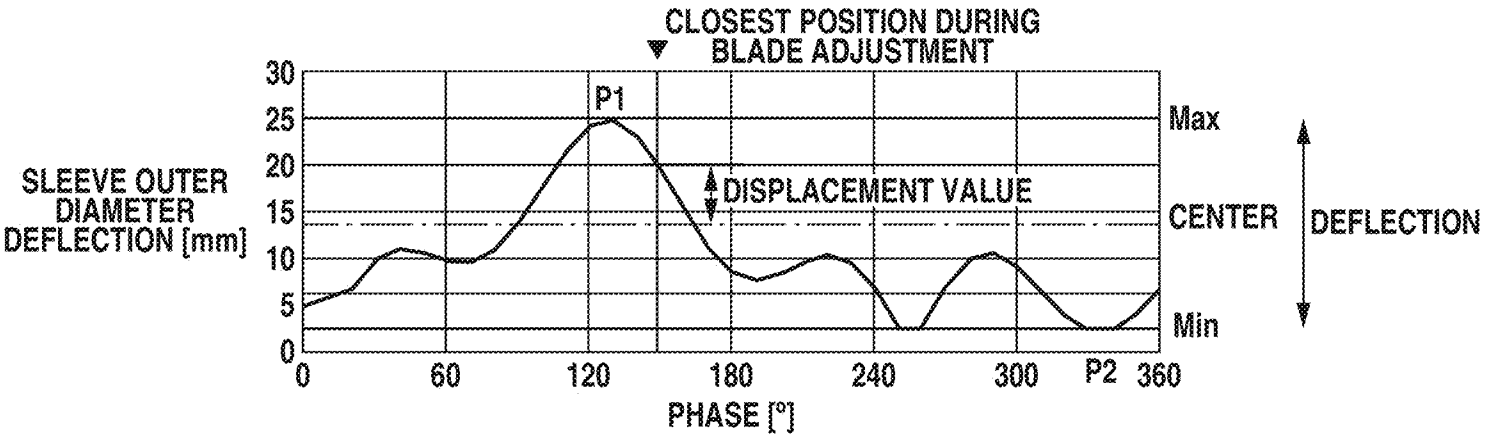

FIGS. 19A and 19B are diagrams each used to explain a deflection of the outer diameter of the developing sleeve 70. FIG. 19C is a diagram illustrating a relationship between a deflection of the outer diameter of the developing sleeve 70 and the size of the SB gap G.

Consider rotating a developing sleeve 70 having a deflection of the outer diameter of the developing sleeve 70 such as that illustrated in FIG. 19A. As illustrated in FIG. 19B, the size of the SB gap G which is targeted to adjust the size of the SB gap G would vary as a portion corresponding to the deflection of the outer diameter of the developing sleeve 70 with a period of one rotation of the developing sleeve 70. Therefore, to reduce the influence of a deflection of the outer diameter of the developing sleeve 70, it is necessary to make adjustment to the center value of the outer diameter of the developing sleeve 70 in such a manner that the size of the SB gap G falls within a predetermined range. Accordingly, a relationship between a deflection of the outer diameter of the developing sleeve 70 and the size of the SB gap G such as that illustrated in FIG. 19C can be taken into consideration.

Next, a portion at which a phase recognition portion of the developing sleeve 70 is provided is described with reference to FIG. 20. The phase recognition portion is provided to recognize the phase of the magnet 71 fixedly located inside the developing sleeve 70 (the phase of the developing sleeve 70).

Figure 20:
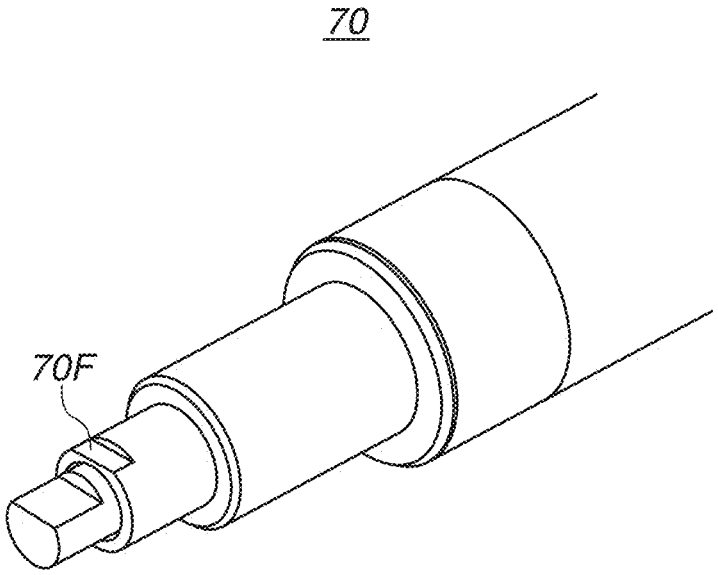
FIG. 20 is a diagram used to explain a portion at which a phase recognition portion of the developing sleeve is provided.

As illustrated in FIG. 20, the phase recognition portion is provided at a portion (70F) equivalent to an end portion in the longitudinal direction of the developing sleeve 70 (an end portion in the longitudinal direction of the shaft portion for magnet). The deviation amount of the phase of the developing sleeve 70 is calculated based on data about a center value of deflection which is a deflection value of the closest position between the phase recognition portion and the regulating blade 36. Then, the range of the size of the SB gap G which is targeted to adjust the size of the SB gap G can be adjusted by displacing the adjustment range of the SB gap G by a value corresponding to the calculated deviation amount of the phase of the developing sleeve 70. This enables adjusting the size of the SB gap G while using the center value of the deflection of the outer diameter of the developing sleeve 70. As a result, the influence of the deflection of the outer diameter of the developing sleeve 70 can be reduced to one-half.

Furthermore, when the size of the SB gap G is adjusted, in a case where the phase of the developing sleeve 70 is only recognized via, for example, a sensor (a camera or a laser device), a variation may occur in the phase of the developing sleeve 70 depending on the attaching state of the developing sleeve 70 to the developing frame member 30. Therefore, all of the pieces of phase data about the deflection of the outer diameter of the developing sleeve 70 become needed.

Accordingly, consider the case of recording all of the pieces of phase data about the deflection of the outer diameter of the developing sleeve 70 on the developing sleeve 70 with use of a two-dimensional barcode. In this case, the apparatus 100 reads the two-dimensional barcode to acquire all of the pieces of phase data about the deflection of the outer diameter of the developing sleeve 70 from the developing sleeve 70, and calculates a displacement amount from the center value. Then, the apparatus 100 can feed back the displacement amount to the center value of the size of the SB gap G which is targeted to adjust the size of the SB gap G. On the other hand, when the size of the SB gap G is adjusted, in a case where the phase of the developing sleeve 70 is fixed to a predetermined position, a position of the developing sleeve 70 closest to the regulating blade 36 when the size of the SB gap G is adjusted is fixed to the predetermined position. Therefore, when a deflection of the outer diameter of the developing sleeve 70 is measured, the displacement amount of the SB gap G to be adjusted as the size of the SB gap G can be calculated.

The present invention is not limited to the above-described exemplary embodiments, but can be modified in various manners (including organic combinations of the embodiments) based on the gist of the present invention, so that such modifications should not be excluded from the scope of the present invention.

While, in the above-described exemplary embodiments, an example in which the regulating pole S1 and a magnetic pole (a scooping pole N1) for generating a magnetic field for scooping up a developer in the developing chamber 31 in such a manner that the developer is borne on the surface of the developing sleeve 70 are configured to be different magnetic poles has been described, the exemplary embodiments are not limited to this example. A configuration in which a single magnetic pole assumes both the role of the regulating pole S1 and the role of the scooping pole N1 can be employed. In such a configuration, the single magnetic pole, while scooping up a developer in the developing chamber 31, generates a magnetic force in such a manner that the amount of a developer passing through the SB gap G is regulated.

Moreover, while, in the above-described exemplary embodiments, as illustrated in FIG. 1, the image forming apparatus 60 having a configuration in which the intermediate transfer belt 61 is used as an intermediate transfer member has been described as an example, the exemplary embodiments are not limited to this. The present invention can also be applied to an image forming apparatus having such a configuration as to perform transfer by directly bringing a recording material into contact with the photosensitive drums 1 in sequence.

Moreover, while, in the above-described exemplary embodiments, the developing device 3 has been described as a single unit, a similar advantageous effect can also be attained by the form of a process cartridge in which the image forming unit 600 (see FIG. 1) including the developing device 3 is integrally unitized and which is attachable to and detachable from the image forming apparatus 60. Additionally, the present invention can also be applied to the image forming apparatus 60 including such a developing device 3 or process cartridge irrespective of a monochromatic machine or color machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A magnet roll provided non-rotatably and stationarily inside a rotatable developer carrying member for carrying and feeding a developer to a developing position, the magnet roll comprising:

a magnet; and a shaft configured to fix the magnet, wherein the magnet roll is provided with information for each individual magnet regarding magnetic flux density of the magnet.

2. The magnet roll according to claim 1, wherein the information for each individual magnet regarding the magnetic flux density of the magnet is provided at the shaft.

3. The magnet roll according to claim 2, wherein a phase recognition portion for recognizing a phase of the magnet is provided at an end portion in a longitudinal direction of the shaft, and wherein the information for each individual magnet regarding the magnetic flux density of the magnet is provided at the phase recognition portion.

4. The magnet roll according to claim 1, wherein the information for each individual magnet regarding the magnetic flux density of the magnet is provided at the magnet.

5. The magnet roll according to claim 1, wherein the magnet roll is provided with a barcode recording the information for each individual magnet regarding the magnetic flux density of the magnet.

6. The magnet roll according to claim 1, wherein the information for each individual magnet regarding the magnetic flux density of the magnet is engraved on the magnet roll.

7. The magnet roll according to claim 1, wherein the information for each individual magnet regarding the magnetic flux density of the magnet is printed on the magnet roll.

8. The magnet roll according to claim 1, wherein the magnet includes a plurality of magnetic poles including a predetermined pole, and wherein the information for each individual magnet regarding the magnetic flux density of the magnet is information for each individual magnet regarding a maximum value of magnetic flux density of the predetermined pole.

9. The magnet roll according to claim 8, wherein the information for each individual magnet regarding the maximum value of the magnetic flux density of the predetermined pole is information for each individual magnet regarding a maximum value of the magnetic flux density of the predetermined pole at a first portion in a longitudinal direction of the magnet and information for each individual magnet regarding a maximum value of the magnetic flux density of the predetermined pole at a second portion different from the first portion in the longitudinal direction of the magnet.

10. The magnet roll according to claim 8, wherein the information for each individual magnet regarding the maximum value of the magnetic flux density of the predetermined pole is information for each individual magnet regarding a maximum value of the magnetic flux density of the predetermined pole at an end portion in a longitudinal direction of the magnet, information for each individual magnet regarding a maximum value of the magnetic flux density of the predetermined pole at another end portion in the longitudinal direction of the magnet, and information for each individual magnet regarding a maximum value of the magnetic flux density of the predetermined pole at a central portion in the longitudinal direction of the magnet.

11. The magnet roll according to claim 1, wherein the magnet includes a plurality of magnetic poles including a predetermined pole, and wherein the information for each individual magnet regarding the magnetic flux density of the magnet is information for each individual magnet regarding a position where magnetic flux density of the predetermined pole becomes maximum.

12. The magnet roll according to claim 11, wherein the information for each individual magnet regarding the position where the magnetic flux density of the predetermined pole becomes maximum is information for each individual magnet regarding a position where the magnetic flux density of the predetermined pole becomes maximum at a first portion in a longitudinal direction of the magnet and information for each individual magnet regarding a position where the magnetic flux density of the predetermined pole becomes maximum at a second portion different from the first portion in the longitudinal direction of the magnet.

13. The magnet roll according to claim 11, wherein the information for each individual magnet regarding the position where the magnetic flux density of the predetermined pole becomes maximum is information for each individual magnet regarding a position where the magnetic flux density of the predetermined pole becomes maximum at an end portion in a longitudinal direction of the magnet, information for each individual magnet regarding a position where the magnetic flux density of the predetermined pole becomes maximum at another end portion in the longitudinal direction of the magnet, and information for each individual magnet regarding a position where the magnetic flux density of the predetermined pole becomes maximum at a central portion in the longitudinal direction of the magnet.

14. The magnet roll according to claim 1, wherein the magnet includes a plurality of magnetic poles including a predetermined pole, and wherein the information for each individual magnet regarding the magnetic flux density of the magnet is information for each individual magnet regarding a maximum value of magnetic flux density of the predetermined pole and information for each individual magnet regarding a position where the magnetic flux density of the predetermined pole becomes maximum.

15. The magnet roll according to claim 14, wherein the information for each individual magnet regarding the maximum value of the magnetic flux density of the predetermined pole is information for each individual magnet regarding a maximum value of the magnetic flux density of the predetermined pole at a first portion in a longitudinal direction of the magnet and information for each individual magnet regarding a maximum value of the magnetic flux density of the predetermined pole at a second portion different from the first portion in the longitudinal direction of the magnet, and wherein the information for each individual magnet regarding the position where the magnetic flux density of the predetermined pole becomes maximum is information for each individual magnet regarding a position where the magnetic flux density of the predetermined pole becomes maximum at the first portion in the longitudinal direction of the magnet and information for each individual magnet regarding a position where the magnetic flux density of the predetermined pole becomes maximum at the second portion in the longitudinal direction of the magnet.

16. The magnet roll according to claim 14, wherein the information for each individual magnet regarding the maximum value of the magnetic flux density of the predetermined pole is information for each individual magnet regarding a maximum value of the magnetic flux density of the predetermined pole at an end portion in a longitudinal direction of the magnet, information for each individual magnet regarding a maximum value of the magnetic flux density of the predetermined pole at another end portion in the longitudinal direction of the magnet, and information for each individual magnet regarding a maximum value of the magnetic flux density of the predetermined pole at a central portion in the longitudinal direction of the magnet, and wherein the information for each individual magnet regarding the position where the magnetic flux density of the predetermined pole becomes maximum is information for each individual magnet regarding a position where the magnetic flux density of the predetermined pole becomes maximum at the end portion in the longitudinal direction of the magnet, information for each individual magnet regarding a position where the magnetic flux density of the predetermined pole becomes maximum at the another end portion in the longitudinal direction of the magnet, and information for each individual magnet regarding a position where the magnetic flux density of the predetermined pole becomes maximum at the central portion in the longitudinal direction of the magnet.

17. The magnet roll according to claim 1, wherein a phase recognition portion for recognizing a phase of the magnet is provided at an end portion in a longitudinal direction of the shaft.

18. The magnet roll according to claim 1, wherein the magnet roll is provided with a recording portion recording the information for each individual magnet regarding the magnetic flux density of the magnet.

19. A developing device comprising:

a developing container configured to contain a developer;

a developer carrying member configured to carry and feed the developer to a developing position; and a regulating member configured to regulate an amount of the developer carried by the developer carrying member, wherein the developer carrying member includes a magnet provided non-rotatably and stationarily inside the developer carrying member, and wherein the developer carrying member is provided with information regarding magnetic flux density of the magnet.

20. The developing device according to claim 19, wherein the magnet includes a plurality of magnetic poles including a regulating pole that is disposed opposite to the regulating member, and wherein the information regarding the magnetic flux density of the magnet is information regarding a maximum value of magnetic flux density of the regulating pole.

21. The developing device according to claim 20, wherein the information regarding the maximum value of the magnetic flux density of the regulating pole is information regarding a maximum value of the magnetic flux density of the regulating pole at an end portion in a longitudinal direction of the magnet, information regarding a maximum value of the magnetic flux density of the regulating pole at another end portion in the longitudinal direction of the magnet, and information regarding a maximum value of the magnetic flux density of the regulating pole at a central portion in the longitudinal direction of the magnet.

22. The developing device according to claim 19, wherein the magnet includes a plurality of magnetic poles including a regulating pole that is disposed opposite to the regulating member, and wherein the information regarding the magnetic flux density of the magnet is information regarding a position where the magnetic flux density of the regulating pole becomes maximum.

23. The developing device according to claim 22, wherein the information regarding the position where the magnetic flux density of the regulating pole becomes maximum is information regarding a position where the magnetic flux density of the regulating pole at an end portion in a longitudinal direction of the magnet becomes maximum, information regarding a position where the magnetic flux density of the regulating pole at another end portion in the longitudinal direction of the magnet becomes maximum, and information regarding a position where the magnetic flux density of the regulating pole at a central portion in the longitudinal direction of the magnet becomes maximum.

24. The developing device according to claim 19, wherein the magnet includes a plurality of magnetic poles including a regulating pole that is disposed opposite to the regulating member, and wherein the information regarding the magnetic flux density of the magnet is information regarding a maximum value of the magnetic flux density of the regulating pole and information regarding a position where the magnetic flux density of the regulating pole becomes maximum.

25. The developing device according to claim 19, wherein the developer carrying member further includes a shaft configured to fix the magnet inside the developer carrying member, and wherein the information regarding the magnetic flux density of the magnet is provided at the shaft.

26. The developing device according to claim 19, wherein the developer carrying member further includes a position determination portion configured to determine a position of the magnet with respect to the regulating member, and wherein the information regarding the magnetic flux density of the magnet is provided at the position determination portion.

27. The developing device according to claim 19, wherein the developer carrying member further includes a flange portion that is disposed at an end portion in a longitudinal direction of the developer carrying member, and wherein the information regarding the magnetic flux density of the magnet is provided at the flange portion.

28. The developing device according to claim 19, wherein the developer carrying member is provided with a barcode recording the information regarding the magnetic flux density of the magnet.

29. The developing device according to claim 19, wherein the information regarding the magnetic flux density of the magnet is engraved on the developer carrying member.

30. The developing device according to claim 19, wherein the information regarding the magnetic flux density of the magnet is printed on the developer carrying member.

31. A developer carrying member configured to carry and feed a developer to a developing position, the developer carrying member comprising:

a rotatable sleeve; and a magnet provided non-rotatably and stationarily inside the rotatable sleeve, wherein the developer carrying member is provided with information for each individual magnet regarding magnetic flux density of the magnet.

32. The developer carrying member according to claim 31, further comprising:

a flange provided at an end portion in a rotational axis direction of the rotatable sleeve, wherein the information for each individual magnet regarding the magnetic flux density of the magnet is provided at the flange.

33. The developer carrying member according to claim 31, wherein the information for each individual magnet regarding the magnetic flux density of the magnet is provided at the rotatable sleeve.

34. The developer carrying member according to claim 31, wherein the developer carrying member is provided with a barcode recording the information for each individual magnet regarding the magnetic flux density of the magnet.

35. The developing carrying member according to claim 31, wherein the information for each individual magnet regarding the magnetic flux density of the magnet is engraved on the developer carrying member.

36. The developing carrying member according to claim 31, wherein the information for each individual magnet regarding the magnetic flux density of the magnet is printed on the developer carrying member.

37. The developer carrying member according to claim 31, wherein the magnet includes a plurality of magnetic poles including a predetermined pole, and wherein the information for each individual magnet regarding the magnetic flux density of the magnet is information for each individual magnet regarding a maximum value of magnetic flux density of the predetermined pole.

38. The developer carrying member according to claim 37, wherein the information for each individual magnet regarding the maximum value of the magnetic flux density of the predetermined pole is information for each individual magnet regarding a maximum value of the magnetic flux density of the predetermined pole at a first portion in a longitudinal direction of the magnet and information for each individual magnet regarding a maximum value of the magnetic flux density of the predetermined pole at a second portion different from the first portion in the longitudinal direction of the magnet.

39. The developer carrying member according to claim 37, wherein wherein the information for each individual magnet regarding the maximum value of the magnetic flux density of the predetermined pole is information for each individual magnet regarding a maximum value of the magnetic flux density of the predetermined pole at an end portion in a longitudinal direction of the magnet, information for each individual magnet regarding a maximum value of the magnetic flux density of the predetermined pole at another end portion in the longitudinal direction of the magnet, and information for each individual magnet regarding a maximum value of the magnetic flux density of the predetermined pole at a central portion in the longitudinal direction of the magnet.

40. The developer carrying member according to claim 31, wherein the magnet includes a plurality of magnetic poles including a predetermined pole, and wherein the information for each individual magnet regarding the magnetic flux density of the magnet is information for each individual magnet regarding a position where magnetic flux density of the predetermined pole becomes maximum.

41. The developer carrying member according to claim 40, wherein the information for each individual magnet regarding the position where the magnetic flux density of the predetermined pole becomes maximum is information for each individual magnet regarding a position where the magnetic flux density of the predetermined pole becomes maximum at a first portion in a longitudinal direction of the magnet and information for each individual magnet regarding a position where the magnetic flux density of the predetermined pole becomes maximum at a second portion different from the first portion in the longitudinal direction of the magnet.

42. The developer carrying member according to claim 40, wherein the information for each individual magnet regarding the position where the magnetic flux density of the predetermined pole becomes maximum is information for each individual magnet regarding a position where the magnetic flux density of the predetermined pole becomes maximum at an end portion in a longitudinal direction of the magnet, information for each individual magnet regarding a position where the magnetic flux density of the predetermined pole becomes maximum at another end portion in the longitudinal direction of the magnet, and information for each individual magnet regarding a position where the magnetic flux density of the predetermined pole becomes maximum at a central portion in the longitudinal direction of the magnet.

43. The developer carrying member according to claim 31, wherein the magnet includes a plurality of magnetic poles including a predetermined pole, and wherein the information for each individual magnet regarding the magnetic flux density of the magnet is information for each individual magnet regarding a maximum value of magnetic flux density of the predetermined pole and information for each individual magnet regarding a position where the magnetic flux density of the predetermined pole becomes maximum.

44. The developer carrying member according to claim 43, wherein the information for each individual magnet regarding the maximum value of the magnetic flux density of the predetermined pole is information for each individual magnet regarding a maximum value of the magnetic flux density of the predetermined pole at a first portion in a longitudinal direction of the magnet and information for each individual magnet regarding a maximum value of the magnetic flux density of the predetermined pole at a second portion different from the first portion in the longitudinal direction of the magnet, and wherein the information for each individual magnet regarding the position where the magnetic flux density of the predetermined pole becomes maximum is information for each individual magnet regarding a position where the magnetic flux density of the predetermined pole becomes maximum at the first portion in the longitudinal direction of the magnet and information for each individual magnet regarding a position where the magnetic flux density of the predetermined pole becomes maximum at the second portion in the longitudinal direction of the magnet.

45. The developer carrying member according to claim 43, wherein the information for each individual magnet regarding the maximum value of the magnetic flux density of the predetermined pole is information for each individual magnet regarding a maximum value of the magnetic flux density of the predetermined pole at an end portion in a longitudinal direction of the magnet, information for each individual magnet regarding a maximum value of the magnetic flux density of the predetermined pole at another end portion in the longitudinal direction of the magnet, and information for each individual magnet regarding a maximum value of the magnetic flux density of the predetermined pole at a central portion in the longitudinal direction of the magnet, and wherein the information for each individual magnet regarding the position where the magnetic flux density of the predetermined pole becomes maximum is information for each individual magnet regarding a position where the magnetic flux density of the predetermined pole becomes maximum at the end portion in the longitudinal direction of the magnet, information for each individual magnet regarding a position where the magnetic flux density of the predetermined pole becomes maximum at the another end portion in the longitudinal direction of the magnet, and information for each individual magnet regarding a position where the magnetic flux density of the predetermined pole becomes maximum at the central portion in the longitudinal direction of the magnet.

46. The developer carrying member according to claim 31, further comprising a shaft configured to fix the magnet, and wherein the information for each individual magnet regarding the magnetic flux density of the magnet is provided at the shaft.

47. The developer carrying member according to claim 46, wherein a phase recognition portion for recognizing a phase of the magnet is provided at an end portion in a longitudinal direction of the shaft, and wherein the information for each individual magnet regarding the magnetic flux density of the magnet is provided at the phase recognition portion.

48. The developer carrying member according to claim 31, further comprising a shaft configured to fix the magnet, and wherein a phase recognition portion for recognizing a phase of the magnet is provided at an end portion in a longitudinal direction of the shaft.

49. The developer carrying member according to claim 31, wherein the information for each individual magnet regarding the magnetic flux density of the magnet is provided at the magnet.

50. The developer carrying member according to claim 31, wherein the developer carrying member is provided with a recording portion recording the information for each individual magnet regarding the magnetic flux density of the magnet.

51. A developing device, comprising:

a developing container configured to contain a developer;

a developer carrying member configured to carry and feed the developer to a developing position, the developer carrying member having a rotatable sleeve and a magnet provided non-rotatably and stationarily inside the rotatable sleeve; and a regulating member configured to regulate an amount of the developer carried by the developer carrying member, wherein the magnet includes a plurality of magnetic poles including a regulating pole that is disposed opposite to the regulating member, and wherein the developer carrying member is provided with information for each individual magnet regarding magnetic flux density of the regulating pole.

52. The developing device according to claim 51, wherein the information for each individual magnet regarding magnetic flux density of the regulating pole is information for each individual magnet regarding a maximum value of magnetic flux density of the regulating pole.

53. The developing device according to claim 52, wherein the information for each individual magnet regarding the maximum value of the magnetic flux density of the regulating pole is information for each individual magnet regarding a maximum value of the magnetic flux density of the regulating pole at an end portion in a longitudinal direction of the magnet, information for each individual magnet regarding a maximum value of the magnetic flux density of the regulating pole at another end portion in the longitudinal direction of the magnet, and information for each individual magnet regarding a maximum value of the magnetic flux density of the regulating pole at a central portion in the longitudinal direction of the magnet.

54. The developing device according to claim 52, wherein the information for each individual magnet regarding the maximum value of the magnetic flux density of the regulating pole is information for each individual magnet regarding a maximum value of the magnetic flux density of the regulating pole at a first portion in a longitudinal direction of the magnet and information for each individual magnet regarding a maximum value of the magnetic flux density of the regulating pole at a second portion different from the first portion in the longitudinal direction of the magnet.

55. The developing device according to claim 51, wherein the information for each individual magnet regarding magnetic flux density of the regulating pole is information for each individual magnet regarding a position where a magnetic flux density of the regulating pole becomes maximum.

56. The developing device according to claim 55, wherein the information for each individual magnet regarding the position where the magnetic flux density of the regulating pole becomes maximum is information for each individual magnet regarding a position where the magnetic flux density of the regulating pole at an end portion in a longitudinal direction of the magnet becomes maximum, information for each individual magnet regarding a position where the magnetic flux density of the regulating pole at another end portion in the longitudinal direction of the magnet becomes maximum, and information for each individual magnet regarding a position where the magnetic flux density of the regulating pole at a central portion in the longitudinal direction of the magnet becomes maximum.

57. The developing device according to claim 55, wherein wherein the information for each individual magnet regarding the position where the magnetic flux density of the regulating pole becomes maximum is information for each individual magnet regarding a position where the magnetic flux density of the regulating pole becomes maximum at a first portion in a longitudinal direction of the magnet and information for each individual magnet regarding a position where the magnetic flux density of the regulating pole becomes maximum at a second portion different from the first portion in the longitudinal direction of the magnet.

58. The developing device according to claim 51, wherein the information for each individual magnet regarding magnetic flux density of the regulating pole is information for each individual magnet regarding a maximum value of magnetic flux density of the regulating pole and information for each individual magnet regarding a position where a magnetic flux density of the regulating pole becomes maximum.

59. The developing device according to claim 58, wherein the information for each individual magnet regarding the maximum value of the magnetic flux density of the regulating pole is information for each individual magnet regarding a maximum value of the magnetic flux density of the regulating pole at a first portion in a longitudinal direction of the magnet and information for each individual magnet regarding a maximum value of the magnetic flux density of the regulating pole at a second portion different from the first portion in the longitudinal direction of the magnet, and wherein the information for each individual magnet regarding the position where the magnetic flux density of the regulating pole becomes maximum is information for each individual magnet regarding a position where the magnetic flux density of the regulating pole becomes maximum at the first portion in the longitudinal direction of the magnet and information for each individual magnet regarding a position where the magnetic flux density of the regulating pole becomes maximum at the second portion in the longitudinal direction of the magnet.

60. The developing device according to claim 58, wherein the information for each individual magnet regarding the maximum value of the magnetic flux density of the regulating pole is information for each individual magnet regarding a maximum value of the magnetic flux density of the regulating pole at an end portion in a longitudinal direction of the magnet, information for each individual magnet regarding a maximum value of the magnetic flux density of the regulating pole at another end portion in the longitudinal direction of the magnet, and information for each individual magnet regarding a maximum value of the magnetic flux density of the regulating pole at a central portion in the longitudinal direction of the magnet, and wherein the information for each individual magnet regarding the position where the magnetic flux density of the regulating pole becomes maximum is information for each individual magnet regarding a position where the magnetic flux density of the regulating pole becomes maximum at the end portion in the longitudinal direction of the magnet, information for each individual magnet regarding a position where the magnetic flux density of the regulating pole becomes maximum at the another end portion in the longitudinal direction of the magnet, and information for each individual magnet regarding a position where the magnetic flux density of the regulating pole becomes maximum at the central portion in the longitudinal direction of the magnet.

61. The developing device according to claim 51, wherein the image bearing member further has a flange provided at an end portion in a rotational axis direction of the rotatable sleeve, wherein the information for each individual magnet regarding the magnetic flux density of the magnet is provided at the flange.

62. The developing device according to claim 51, wherein the information for each individual magnet regarding the magnetic flux density of the magnet is provided at the rotatable sleeve.

63. The developing device according to claim 51, wherein the developer carrying member further has a shaft configured to fix the magnet, and wherein the information for each individual magnet regarding the magnetic flux density of the magnet is provided at the shaft.

64. The developing device according to claim 63, wherein a phase recognition portion for recognizing a phase of the magnet is provided at an end portion in a longitudinal direction of the shaft, and wherein the information for each individual magnet regarding the magnetic flux density of the magnet is provided at the phase recognition portion.

65. The developing device according to claim 51, wherein the developer carrying member further has a shaft configured to fix the magnet, and wherein a phase recognition portion for recognizing a phase of the magnet is provided at an end portion in a longitudinal direction of the shaft.

66. The developing device according to claim 51, wherein the developer carrying member is provided with a barcode recording the information for each individual magnet regarding the magnetic flux density of the magnet.

67. The developing device according to claim 51, wherein the information for each individual magnet regarding the magnetic flux density of the magnet is engraved on the developer carrying member.

68. The developing device according to claim 51, wherein the information for each individual magnet regarding the magnetic flux density of the magnet is printed on the developer carrying member.

69. The developing device according to claim 51, wherein the information for each individual magnet regarding the magnetic flux density of the magnet is provided at the magnet.

70. The developing device according to claim 51, wherein the developer carrying member is provided with a recording portion recording the information for each individual magnet regarding the magnetic flux density of the magnet.

71. A method of manufacturing a developing device including a developing container configured to contain a developer, a developer carrying member configured to carry and feed the developer to a developing position, and a regulating member configured to regulate an amount of the developer carried by the developer carrying member, the developer carrying member including a magnet provided non-rotatably and stationarily inside the developer carrying member, the method comprising:

obtaining information for each individual magnet regarding magnetic flux density of the magnet from the developer carrying member;

adjusting a position of the regulating member with respect to the developer carrying member based on the information regarding the magnetic flux density of the magnet, which has been obtained in the obtaining; and fixing the regulating member to the developing container in a state that the position of the regulating member with respect to the developer carrying member is adjusted in the adjusting.

72. The method of manufacturing the developing device according to claim 71, wherein the magnet includes a plurality of magnetic poles including a regulating pole that is disposed opposite to the regulating member, wherein, in the obtaining, information for each individual magnet regarding a maximum value of magnetic flux density of the regulating pole is obtained from the developer carrying member as the information for each individual magnet regarding the magnetic flux density of the magnet, and wherein, in the adjusting, the position of the regulating member with respect to the developer carrying member is adjusted based on the information for each individual magnet regarding the maximum value of the magnetic flux density of the regulating pole, which has been obtained in the obtaining.

73. The method of manufacturing the developing device according to claim 71, wherein the magnet includes a plurality of magnetic poles including a regulating pole that is disposed opposite to the regulating member, wherein, in the obtaining, information for each individual magnet regarding a position where magnetic flux density of the regulating pole becomes maximum is obtained from the developer carrying member as the information for each individual magnet regarding the magnetic flux density of the magnet, and wherein, in the adjusting, the position of the regulating member with respect to the developer carrying member is adjusted based on the information for each individual magnet regarding the position where the magnetic flux density of the regulating pole becomes maximum, which has been obtained in the obtaining.

74. The method of manufacturing the developing device according to claim 71, wherein the magnet includes a plurality of magnetic poles including a regulating pole that is disposed opposite to the regulating member, wherein, in the obtaining, information for each individual magnet regarding a maximum value of magnetic flux density of the regulating pole and information for each individual magnet regarding a position where the magnetic flux density of the regulating pole becomes maximum are obtained from the developer carrying member as the information for each individual magnet regarding magnetic flux density of the magnet, and wherein, in the adjusting, the position of the regulating member with respect to the developer carrying member is adjusted based on the information for each individual magnet regarding the maximum value of the magnetic flux density of the regulating pole and the information for each individual magnet regarding the position where the magnetic flux density of the regulating pole becomes maximum, both of which have been obtained in the obtaining.

75. The method of manufacturing the developing device according to claim 71, further comprising:

reading a barcode provided on the developer carrying member, the barcode recording the information for each individual magnet regarding the magnetic flux density of the magnet, wherein, in the obtaining, the information for each individual magnet regarding the magnetic flux density of the magnet is obtained from the developer carrying member by reading the barcode in the reading.

76. The method of manufacturing the developing device according to claim 71, further comprising:

fixing the developer carrying member to the developing container, wherein, in the obtaining, the information for each individual magnet regarding the magnetic flux density of the magnet is obtained from the developer carrying member fixed to the developing container in the fixing.

77. The method of manufacturing the developing device according to claim 71, further comprising:

determining a target value of a gap between the developer carrying member and the regulating member based on the information for each individual magnet regarding the magnetic flux density of the magnet, which has been obtained in the obtaining, wherein, in the adjusting, the position of the regulating member with respect to the developer carrying member is adjusted based on the target value determined in the determining.

78. The method of manufacturing the developing device according to claim 71, further comprising:

determining a maximum value of a gap between the developer carrying member and the regulating member and a minimum value of the gap between the developer carrying member and the regulating member based on the information for each individual magnet regarding the magnetic flux density of the magnet, which has been obtained in the obtaining, wherein, in the adjusting, the position of the regulating member with respect to the developer carrying member is adjusted so that a size of the gap is set at a value between the maximum value and the minimum value, both of which have been determined in the determining.

79. The method of manufacturing the developing device according to claim 71, wherein the developer carrying member further includes a rotatable sleeve, and a flange provided at an end portion in a rotational axis direction of the rotatable sleeve, wherein the magnet is provided non-rotatably and stationarily inside the rotatable sleeve, and wherein the information for each individual magnet regarding the magnetic flux density of the magnet is provided at the flange.

80. The method of manufacturing the developing device according to claim 79, wherein the developer carrying member further includes a rotatable sleeve, wherein the magnet is provided non-rotatably and stationarily inside the rotatable sleeve, and wherein the information for each individual magnet regarding the magnetic flux density of the magnet is provided at the rotatable sleeve.

81. The method of manufacturing the developing device according to claim 71, wherein the developer carrying member is provided with a recording portion recording the information for each individual magnet regarding the magnetic flux density of the magnet.

82. The method of manufacturing the developing device according to claim 71, wherein the developer carrying member is provided with a barcode recording the information for each individual magnet regarding the magnetic flux density of the magnet.

83. The method of manufacturing the developing device according to claim 71, wherein the information for each individual magnet regarding the magnetic flux density of the magnet is engraved on the developer carrying member.

84. The method of manufacturing the developing device according to claim 71, wherein the information for each individual magnet regarding the magnetic flux density of the magnet is printed on the developer carrying member.

85. The method of manufacturing the developing device according to claim 71, wherein the developer carrying member further includes a shaft configured to fix the magnet, and wherein the information for each individual magnet regarding the magnetic flux density of the magnet is provided at the shaft.

86. The method of manufacturing the developing device according to claim 85, wherein the developer carrying member further includes a phase recognition portion for recognizing a phase of the magnet, the phase recognition portion being provided at an end portion in a longitudinal direction of the shaft, and wherein the information for each individual magnet regarding the magnetic flux density of the magnet is provided at the phase recognition portion.

87. The method of manufacturing the developing device according to claim 71, wherein the developer carrying member further includes a shaft configured to fix the magnet, and wherein a phase recognition portion for recognizing a phase of the magnet is provided at an end portion in a longitudinal direction of the shaft.

88. The method of manufacturing the developing device according to claim 71, wherein the information for each individual magnet regarding the magnetic flux density of the magnet is provided at the magnet.

* * * * *